US007258968B1

(12) United States Patent
LaBelle et al.

(10) Patent No.: US 7,258,968 B1
(45) Date of Patent: Aug. 21, 2007

(54) THERMALLY DEVELOPABLE MATERIALS WITH BURIED CONDUCTIVE BACKSIDE COATINGS

(75) Inventors: Gary E. LaBelle, Stillwater, MN (US); Thomas J. Ludermann, Maplewood, MN (US); Kumars Sakizadeh, Woodbury, MN (US); Thomas J. Kub, North Stillwater, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 11/403,438

(22) Filed: Apr. 13, 2006

(51) Int. Cl.
*G03C 5/16* (2006.01)
*G03C 1/85* (2006.01)
*G03C 1/498* (2006.01)

(52) U.S. Cl. ..... 430/351; 430/523; 430/527; 430/529; 430/530; 430/631

(58) Field of Classification Search ..... 430/523, 430/527, 529, 530, 631, 350
See application file for complete search history.

(56) References Cited

U.S. PATENT DOCUMENTS 4,582,781 A * 4/1986 Chen et al. ..... 430/527
5,674,671 A 10/1997 Brandon et al.
6,132,950 A 10/2000 Ishigaki et al.
6,171,707 B1 1/2001 Gomez et al.
6,287,754 B1 9/2001 Melpolder et al.
6,689,546 B1 2/2004 LaBelle et al.
6,699,648 B2 3/2004 Sakizadeh et al.
6,811,724 B2 11/2004 Majumdar et al.
2005/0006629 A1 1/2005 Majumdar et al.

FOREIGN PATENT DOCUMENTS

JP 2005/0099654 4/2005

* cited by examiner

*Primary Examiner*—Thorl Chea

(57) ABSTRACT

Thermally developable materials including photothermographic and thermographic materials having a buried conductive backside layer comprising one or more binder polymers, and an antistatic compound that is an organic solvent soluble alkali metal salt of any of a perfluorinated aliphatic carboxylic acid having 2 or 3 carbon atoms, a perfluorinated aliphatic sulfonate, or a tetrafluoroborate, provide antistatic coatings that exhibit little dependence on humidity.

23 Claims, No Drawings

THERMALLY DEVELOPABLE MATERIALS WITH BURIED CONDUCTIVE BACKSIDE COATINGS

FIELD OF THE INVENTION

This invention relates to thermally developable materials having buried conductive backside coatings and to methods of imaging using these materials. In particular, this invention relates thermographic and photothermographic materials.

BACKGROUND OF THE INVENTION

Silver-containing direct thermographic and photothermographic imaging materials (that is, thermally developable imaging materials) that are imaged and/or developed using heat and without liquid processing have been known in the art for many years.

Silver-containing direct thermographic imaging materials are non-photosensitive materials that are used in a recording process wherein images are generated by the direct application of thermal energy and in the absence of a processing solvent. These materials generally comprise a support having disposed thereon (a) a relatively or completely non-photosensitive source of reducible silver ions, (b) a reducing composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise non-photosensitive reducible silver salts of long chain fatty acids. A preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby elemental silver is formed. Preferred reducing agents include methyl gallate, hydroquinone, substituted-hydroquinones, hindered phenols, catechols, pyrogallol, ascorbic acid, and ascorbic acid derivatives.

Some thermographic constructions are imaged by contacting them with the thermal head of a thermographic recording apparatus such as a thermal print-head of a thermal printer or thermal facsimile. In such constructions, an anti-stick layer is coated on top of the imaging layer to prevent sticking of the thermographic construction to the thermal head of the apparatus utilized. The resulting thermographic construction is then heated imagewise to an elevated temperature, typically in the range of from about 60 to about 225° C., resulting in the formation of a black-and-white image of silver.

Silver-containing photothermographic imaging materials (that is, photosensitive thermally developable imaging materials) that are imaged with actinic radiation and then developed using heat and without liquid processing, have also been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a binder. The latent image is then developed by application of thermal energy.

In photothermographic materials, exposure of the photosensitive silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image of silver while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. Upon heating, and at elevated temperatures, the reducible silver ions are reduced by the reducing agent. This reaction occurs preferentially in the regions surrounding the latent image. This reaction produces a negative image of metallic silver having a color that ranges from yellow to deep black depending upon the presence of toning agents and other components in the photothermographic imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created in the absence of a processing solvent by heat as a result of the reaction of a reducing agent incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the reducing agent into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74-75, in D. H. Klosterboer, *Imaging Processes and Materials*, (Neblette's Eighth Edition), J. Sturge, V. Walworth, and A. Shepp, Eds., Van Nostrand-Reinhold, New York, 1989, Chapter 9, pp. 279-291, in Zou et al., *J. Imaging Sci. Technol.* 1996, 40, pp. 94-103, and in M. R. V Sahyun, *J. Imaging Sci. Technol.* 1998, 42, 23.

Problem to be Solved

Photothermographic and thermographic materials have been designed and commercialized with one or more backside (non-imaging side) layers for a number of years. Such layers are designed to have various functional properties including conductive (or antistatic), antihalation, protective, and improved machine feeding and transport properties. Efforts have been continuing to provide backside layers with improved functional properties as well as to reduce manufacturing and component costs.

Many of the chemicals used to make supports or supported layers in thermally developable materials have electrically insulating properties, and electrostatic charges frequently build up on the materials during manufacture, packaging, and use. The accumulated charges can cause various problems. For example, in photothermographic materials containing photosensitive silver halides, accumulated electrostatic charge can generate light to which the silver halides are sensitive. This may result in imaging defects that are a particular problem where the images are used for medical diagnosis.

Build-up of electrostatic charge can also cause sheets of thermally processable materials to stick together causing misfeeds and jamming within processing equipment. Additionally, accumulated electrostatic charge can attract dust or other particulate matter to the materials, thereby requiring more cleaning to insure rapid transport through the processing equipment and quality imaging.

Build-up of electrostatic charge also makes handling of developed sheets of imaged material more difficult. For example, radiologists desire a static free sheet for viewing on light boxes. This problem can be particularly severe when reviewing an imaged film that has been stored for a long period of time because many antistatic materials loose their effectiveness over time.

In general, build-up of electrostatic charge is related to surface resistivity (measured in log ohm/sq) and rate of charge decay. While electrostatic charge control agents (also known as "antistatic agents" or "antistats") can be included in any layer of an imaging material, the accumulation of electrostatic charge can be prevented by reducing the surface resistivity or by lowering the charge level. These results can most often be achieved by including charge control agents in surface layers such as protective overcoats or in buried layers. In thermally processable materials, charge control agents may be used in backing layers that are on the opposite side of the support as the imaging layers.

As noted above, there are many conductive compounds described for use in imaging materials. However, it is generally impossible to merely choose a compound from the literature and include it in an antistatic composition for use in specific types of imaging materials. There are so many parameters and properties that are affected by each coating component and while the desired conductivity may be achieved, other properties may be adversely affected. A careful balancing act is required by the industrial researcher to find the best conductive compounds that achieve as many desired properties as possible. Optimization to achieve all desired properties is usually more than a routine task.

For example, to be useful in a "buried" conductive backside layer in a hydrophobic binder coated from nonpolar organic solvents, a conductive compound generally must be compatible with the hydrophobic binder and have no detrimental effects upon any components in any overcoat layers, have only minimal migration into any overcoat or adjacent layers, generate minimal haze on the backside, and provide a log resistivity of less than $10^{12}$ ohm/sq that is relatively invariant with changes in humidity. In addition, the conductive material should not disrupt adhesion between the polymeric support and any overcoat or undercoat layers. It should readily dissipate charge and have a static decay time of 100 seconds or less (preferably 25 seconds or less).

Preferably, the conductive materials should not cause surface irregularities such as blush, smearing, or coating voids (known as "de-wetting") on any overcoat layers and should not react with the polymer binders or other materials in other backside layers of the thermally developable materials during storage, imaging, development, or post-development storage.

A wide variety of organic and inorganic charge control agents have been devised and used for electrostatic charge control. Metal oxides are described in conductive layers in U.S. Pat. Nos. 5,340,676 (Anderson et al.), 5,368,995 (Christian et al.), 5,457,013 (Christian et al.), 6,464,413 (Oyamada), and 5,731,119 (Eichorst et al.).

U.S. Pat. No. 6,355,405 (Ludemann et al.) describes thermally developable materials that include very thin adhesion-promoting layers on either side of the support. These adhesion-promoting layers are also known as "carrier" layers. U.S. Pat. No. 6,689,546 (LaBelle et al.) describes thermally developable materials that contain a buried conductive backside "carrier" layer comprising non-acicular metal antimonate particles.

Various fluorochemicals have been used for the purpose of reducing the generation of surface electrostatic charge as described, for example, in U.S. Pat. Nos. 5,674,671 (Brandon et al.), 6,171,707 (Gomez et al.), 6,287,754 (Melpolder et al.), and 6,699,648 (Sakizadeh et al.). Polyoxyalkyleneamines that are useful for making such fluorinated organic salts include JEFFAMINE® compounds (currently available from Huntsman Corp.). One such electrostatic charge control agent is the perfluorooctylsulfonyl (PFOS) salt of a polyoxyalkyleneamine described as Compound 1 in U.S. Pat. No. 4,975,363 (Cavallo et al.).

U.S. Pat. No. 6,811,724 and U.S. Patent Application Publication 2005/0006629 (Majumdar et al.) describe the use of a combination of a polyethylene ether glycol and lithium nitrate in an antistatic layer.

Despite the considerable research and knowledge in the art relating to various conductive polymers, metal oxide particles, fluorochemicals and other materials in conductive compositions and imaging materials, there remains a need for additional conductive materials for use layers on the backside of thermally developable materials that are low in cost, can be coated from organic solvents, and meet many if not all of the general or specific requirements described above for conductive or antistatic layers.

SUMMARY OF THE INVENTION

To address this need, this invention provides a thermally developable material that comprises a support having on one side thereof, one or more thermally developable imaging layers comprising a binder and in reactive association, a non-photosensitive source of reducible silver ions, and a reducing agent composition for the non-photosensitive source reducible silver ions, and having disposed on the backside of the support:

a buried conductive backside layer comprising one or more binder polymers, and an antistatic compound that is an organic solvent soluble alkali metal salt of any of a perfluorinated aliphatic carboxylic acid having 2 or 3 carbon atoms, a perfluorinated aliphatic sulfonate, or tetrafluoroborate, that is present in an amount sufficient to provide a water electrode resistivity of $1\times10^{12}$ ohm/sq or less at 21.1° C. and 50% relative humidity, and a static decay time of less than 100 seconds at 21.1° C. and 20% relative humidity, and an outermost backside layer.

In another embodiment, this invention provides a black-and-white, organic solvent-based photothermographic material comprising a support and A) having on an imaging side of the support, one or more photothermographic emulsion layers, and a protective layer disposed over the photothermographic emulsion layers, and in reactive association:

photosensitive grains of silver bromide or iodobromide that are sensitized to an exposure wavelength of at least 600 nm, one or more silver salts of aliphatic fatty acids including silver behenate, a reducing agent composition comprising a hindered phenol, a hindered bisphenol, or a combination thereof, and a hydrophobic, organic solvent-soluble binder, B) having on the backside of the support, a buried conductive backside layer comprising one or more first organic solvent soluble hydrophobic binder polymers in which is dissolved one or more alkali metal salts of any of a perfluorinated aliphatic carboxylic acid having 2 or 3 carbon atoms in an amount of from about 0.02 to about 2 g/m$^2$ to provide a water electrode resistivity of $1\times10^{11}$ ohm/sq or less at 21.1° C. and 50% relative humidity, and disposed directly on the buried conductive backside layer, an outermost backside layer comprising one or more second hydrophobic binder polymers at least one of which differs from the first hydrophobic binder polymers, and one or more of a polysiloxane, amorphous silica particles, a smectite clay that has been modified with a quaternary ammonium compound, a wax, or polytetra-fluoroethylene particulates, wherein:

C) the silver coating weight of the photothermographic material is from about 1 to about 2 g/m$^2$, the absorbance on the imaging side at an exposure wavelength is at least 0.6, and the absorbance on the backside at an exposure wavelength is at least 0.2, the buried conductive backside layer and the outermost backside layer exhibit a haze of 13% or less, and a static decay time of 25 seconds or less.

This invention further provides a method of forming a visible image comprising:

(A) imagewise exposing a thermally developable material of this invention that is a photothermographic material to electromagnetic radiation to form a latent image, (B) simultaneously or sequentially, heating the exposed photothermographic material to develop the latent image into a visible image.

In alternative methods of this invention, a method of forming a visible image comprises:

(A') thermal imaging of the thermally developable material of this invention that is a thermographic material.

We have found that the addition of organic solvent soluble alkali metal salts of any of a perfluorinated aliphatic carboxylic acid having 2 or 3 carbon atoms, a perfluorinated aliphatic sulfonate, or a tetrafluoroborate, provides conductivity to buried backside layers. These antistatic compounds are low in cost and can be conveniently incorporated into hydrophobic binders and coated from non-polar organic solvents. In addition, many of the conductive materials described herein provide additional benefits, or do not adversely affect various properties, such as haze, adhesion, and coating quality. The most preferred compounds described below also provide backside antistatic constructions having static decay times of 25 seconds or less.

DETAILED DESCRIPTION OF THE INVENTION

The thermally developable materials described herein are both thermographic and photothermographic materials. While the following discussion will often be directed primarily to the preferred photothermographic embodiments, it would be readily understood by one skilled in the art that thermographic materials can be similarly constructed and used to provide black-and-white or color images using appropriate imaging chemistry and particularly non-photosensitive organic silver salts, reducing agents, toners, binders, and other components known to a skilled artisan. In both thermographic and photothermographic materials, the antistatic compounds described herein are incorporated into the buried conductive backside layer on the backside of the support.

The thermally developable materials of this invention can be used in black-and-white or color thermography and photothermography and in electronically generated black-and-white or color hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, image-setting and phototypesetting), in the manufacture of printing plates, in contact printing, in duplicating ("duping"), and in proofing.

The thermally developable materials are particularly useful for imaging of human or animal subjects in response to visible, X-radiation, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are particularly useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation at 600 nm or greater (and preferably sensitive to infrared radiation from about 700 up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer.

Similarly, in the thermographic materials of this invention, the components needed for imaging can be in one or more layers. The layer(s) that contain the non-photosensitive source of reducible silver ions are referred to herein as thermographic emulsion layer(s).

As the materials contain imaging layers on one side of the support only, various non-imaging layers may be disposed on the "backside" (non-emulsion or non-imaging side) of the support, including, interlayers, adhesion promoting layers, and antihalation layer(s), in addition to the buried conductive backside layers comprising the antistatic compounds described herein.

Various non-imaging layers can also be disposed on the "frontside" or imaging or emulsion side of the support, including protective frontside overcoat layers, primer layers, interlayers, opacifying layers, antistatic layers, antihalation layers, acutance layers, auxiliary layers, and other layers readily apparent to one skilled in the art.

When the thermally developable materials are heat-developed as described below in a substantially water-free condition after, or simultaneously with, imagewise exposure, a silver image (preferably a black-and-white silver image) is obtained.

Definitions

As used herein:

In the descriptions of the thermally developable materials, "a" or "an" component refers to "at least one" of that component (for example, the antistatic compounds described herein).

As used herein, "black-and-white" preferably refers to an image formed by silver metal.

Unless otherwise indicated, when the terms "thermally developable materials", "photothermographic materials", and "thermographic materials" are used herein, the terms refer to materials of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water or any other solvent for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a dry processable integral element comprising a support and at least one photothermographic emulsion layer or a photothermographic set of emulsion layers (wherein the photosensitive silver halide and the source of reducible silver ions are in one layer and the other necessary components or additives are distributed, as desired, in the same layer or in an adjacent coated layer). In the case of black-and-white thermally developable materials, a black-and-white silver image is produced. These materials also include multilayer constructions in which one or more imaging components are in different layers, but are in "reactive association". For example, one layer can include the non-photosensitive source of reducible silver ions and another layer can include the reducing composition, but the two reactive components are in reactive association with each other. By "integral", we mean that all imaging chemistry required for imaging is in the material without diffusion of imaging chemistry or reaction products (such as a dye) from or to another element (such as a receiver element).

"Thermographic materials" are similarly defined except that no photosensitive silver halide catalyst is purposely added or created.

When used in photothermography, the term, "imagewise exposing" or "imagewise exposure" means that the material is imaged as a dry processable material using any exposure means that provides a latent image using electro-magnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged as a dry processable material using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads or by thermal heating using scanning laser radiation.

"Catalytic proximity" or "reactive association" means that the reactive components are in the same layer or in adjacent layers so that they readily come into contact with each other during imaging and thermal development.

The term "emulsion layers", "imaging layer", "thermographic emulsion layer", or "photothermographic emulsion layer" means a layer of a thermographic or photothermographic material that contains the photosensitive silver halide (when used) and/or non-photosensitive source of reducible silver ions, or a reducing composition. Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Transparent" means capable of transmitting visible light or imaging radiation without appreciable scattering or absorption.

The phrases "silver salt" and "organic silver salt" refer to an organic molecule having a bond to a silver atom. Although the compounds so formed are technically silver coordination complexes or silver compounds they are also often referred to as silver salts.

The phrase "aryl group" refers to an organic group derived from an aromatic hydrocarbon by removal of one atom, such as a phenyl group formed by removal of one hydrogen atom from benzene.

The term "perfluorinated" means that substantially all the hydrogen atoms in the molecule have been replaced by fluorine atoms.

The term "alkali metal" has its usual meaning and refers to lithium, sodium, potassium, rubidium, and cesium. Cations of alkali metals have a (+1) valance.

The term "buried layer" means that there is at least one other layer disposed over the layer (such as a "buried" conductive backside layer).

The terms "coating weight", "coat weight", and "coverage" are synonymous, and are usually expressed in weight or moles per unit area such as $g/m^2$ or $mol/m^2$.

"Haze" is wide-angle scattering that diffuses light uniformly in all directions, wherein the light intensity per angle is small. Haze reduces contrast and results in a milky or cloudy appearance. Haze is the percentage of transmitted light that deviates from the incident beam by more than 2.5 degrees on the average. The lower the haze number, the less hazy the material.

By organic solvent, we mean an organic hydrophobic solvent having a "clogP" (octanol-water partition coefficient) value greater than or equal to 0.

As is well understood in this art, for the chemical compounds herein described, substitution is not only tolerated, but is often advisable and various substitutents are anticipated on the compounds used in the present invention unless otherwise stated. Thus, when a compound is referred to as "having the structure" of a given formula or being a derivative of a compound, any substitution that does not alter the bond structure of the formula or the shown atoms within that structure is included within the formula, unless such substitution is specifically excluded by language.

As a means of simplifying the discussion and recitation of certain substitutent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substitutents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substitutents, would, of course, be excluded by the skilled artisan as not being inert or harmless.

Research Disclosure (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

As noted above, photothermographic materials include one or more photocatalysts in the photothermographic emulsion layer(s). Useful photo-catalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100 mol % iodide. Even more preferably, the silver bromoiodide comprises at least 70 mole % (preferably at least 85 mole % and most preferably at least 90 mole %) bromide (based on total silver halide). The remainder of the halide is either iodide or chloride and iodide. Preferably, the additional halide is iodide. Silver bromide and silver bromoiodide are most preferred, with the latter silver halide generally having up to 10 mol % silver iodide.

In some embodiments of aqueous-based photothermographic materials, higher amounts of iodide may be present in homogeneous photo-sensitive silver halide grains, and particularly from about 20 mol % up to the saturation limit of iodide as described, for example, U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.), incorporated herein by reference. Iridium and/or copper doped core-shell and non-core-shell grains are described in U.S. Pat. Nos. 5,434,043 (Zou et al.) and 5,939,249 (Zou), both incorporated herein by reference. Bismuth (+3)-doped high silver iodide emulsions for photothermographic materials are described in U.S. Pat. No. 6,942,960 (Maskasky et al.).

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) as described in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is preferable to form the non-photo-sensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials to provide a material often referred to as a "preformed soap" [see U.S. Pat. No. 3,839,049 (Simons)].

In some constructions, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. Nos. 2,489,341 (Waller et al.), 2,565,418 (Yackel), 2,614,928 (Yutzy et al.), 2,618,556 (Hewitson et al.), and 3,241,969 (Hart et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in Research Disclosure, June 1978, item 17029, U.S. Pat. Nos. 3,700,458 (Lindholm) and 4,076,539 (Ikenoue et al.), and Japanese Kokai 49-013224 (Fuji), 50-017216 (Fuji), and 51-042529 (Fuji).

The silver halide grains used in the imaging formulations can vary in average diameter of up to several micrometers (μM) depending on the desired use. Preferred silver halide grains for use in preformed emulsions containing silver carboxylates are cubic grains having a number average particle size of from about 0.01 to about 1.0 μm, more preferred are those having a number average particle size of from about 0.03 to about 0.1 μm. It is even more preferred that the grains have a number average particle size of 0.06 μm or less, and most preferred that they have a number average particle size of from about 0.03 to about 0.06 μm. Mixtures of grains of various average particle size can also be used. Preferred silver halide grains for high-speed photothermographic constructions use are tabular grains having an average thickness of at least 0.02 μm and up to and including 0.10 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light Microscopy, R. P. Loveland, 1955, pp. 94-122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149-169. Suitable conventional chemical sensitization procedures are also described in U.S. Pat. Nos. 1,623,499

(Sheppard et al.), 2,399,083 (Waller et al.), 3,297,446 (Dunn), 3,297,447 (McVeigh), 5,049,485 (Deaton), 5,252,455 (Deaton), 5,391,727 (Deaton), 5,759,761 (Lushington et al.), and 5,912,111 (Lok et al.), and EP 0 915 371 A1 (Lok et al.), all of which are incorporated herein by reference.

Mercaptotetrazoles and tetraazaindenes as described in U.S. Pat. No. 5,691,127 (Daubendiek et al.), incorporated herein by reference, can also be used as suitable addenda for tabular silver halide grains.

Certain substituted and unsubstituted thiourea compounds can be used as chemical sensitizers including those described in U.S. Pat. No. 6,368,779 (Lynch et al.) that is incorporated herein by reference.

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.), that are both incorporated herein by reference.

Combinations of gold(III)-containing compounds and either sulfur-, tellurium-, or selenium-containing compounds are also useful as chemical sensitizers as described in U.S. Pat. No. 6,423,481 (Simpson et al.) that is also incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidizing environment are the diphenylphosphine sulfide compounds described in U.S. Pat. No. 7,026,105 (Simpson et al.) and in copending and commonly assigned U.S. Patent Application Publications 2005/0123871 (Burleva et al.) and 2005/123872 (Burleva et al.). The above patents and patent application publications are incorporated herein by reference.

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 μm.

Spectral Sensitization

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1200 nm). It is preferred that the photosensitive silver halide be sensitized to infrared radiation (that is from about 700 to about 950 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved.

Suitable spectral sensitizing dyes such as those described in U.S. Pat. Nos. 3,719,495 (Lea), 4,396,712 (Kinoshita et al.), 4,439,520 (Kofron et al.), 4,690,883 (Kubodera et al.), 4,840,882 (Iwagaki et al.), 5,064,753 (Kohno et al.), 5,281,515 (Delprato et al.), 5,393,654 (Burrows et al.), 5,441,866 (Miller et al.), 5,508,162 (Dankosh), 5,510,236 (Dankosh), and 5,541,054 (Miller et al.), Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), can be used. Useful spectral sensitizing dyes are also described in Research Disclosure, December 1989, item 308119, Section IV and Research Disclosure, 1994, item 36544, section V. All of the publications noted above are incorporated herein by reference.

Teachings relating to specific combinations of spectral sensitizing dyes also include U.S. Pat. Nos. 4,581,329 (Sugimoto et al.), 4,582,786 (Ikeda et al.), 4,609,621 (Sugimoto et al.), 4,675,279 (Shuto et al.), 4,678,741 (Yamada et al.), 4,720,451 (Shuto et al.), 4,818,675 (Miyasaka et al.), 4,945,036 (Arai et al.), and 4,952,491 (Nishikawa et al.). All of the above publications and patents are incorporated herein by reference.

Also useful are spectral sensitizing dyes that decolorize by the action of light or heat as described in U.S. Pat. No. 4,524,128 (Edwards et al.) and Japanese Kokai 2001-109101 (Adachi), 2001-154305 (Kita et al.), and 2001-183770 (Hanyu et al.), all incorporated herein by reference.

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide, when used in a photothermographic material) and a reducing agent composition.

The primary organic silver salt is often a silver salt of an aliphatic carboxylic acid (described below). Mixtures of silver salts of aliphatic carboxylic acids are particularly useful where the mixture includes at least silver behenate.

Useful silver carboxylates include silver salts of long-chain aliphatic carboxylic acids. The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α- (on a hydrocarbon group) or ortho- (on an aromatic group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aryl carboxylic acids (such as silver benzoate), silver salts of acetylenes as described, for example in U.S. Pat. Nos. 4,761,361 (Ozaki et al.) and 4,775,613 (Hirai et al.), and silver salts of heterocyclic compounds containing mercapto or thione groups and derivatives as described in U.S. Pat. Nos. 4,123,274 (Knight et al.) and 3,785,830 (Sullivan et al.).

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in Research Disclosure, April 1983, item 22812, Research Disclosure, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.), wherein a core has one or more silver salts and a shell has one or more different silver salts, as long as one of the silver salts is a silver carboxylate. Other useful sources of non-photosensitive reducible silver ions are the silver dimer compounds that comprise two different silver salts as described in U.S. Pat. No. 6,472,131 (Whitcomb). Still other useful sources of non-photosensitive reducible silver ions are the silver core-shell compounds comprising a primary core comprising one or more photosensitive silver halides, or one or more non-photo-sensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,802,177 (Bokhonov et al.). All of the above patents are incorporated herein by reference.

Organic silver salts that are particularly useful in organic solvent-based thermographic and photothermographic materials include silver carboxylates (both aliphatic and aryl carboxylates), silver benzotriazolates, silver sulfonates, silver sulfosuccinates, and silver acetylides. Silver salts of long-chain aliphatic carboxylic acids containing 15 to 28 carbon atoms and silver salts of benzotriazole are particularly preferred.

Organic silver salts that are particularly useful in aqueous based thermographic and photothermographic materials include silver salts of compounds containing an imino group. Preferred examples of these compounds include, but are not limited to, silver salts of benzotriazole and substituted derivatives thereof (for example, silver methylbenzotriazole and silver 5-chloro-benzotriazole), silver salts of 1,2,4-triazoles or 1-H-tetrazoles such as phenyl-mercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of a benzotriazole is particularly preferred in aqueous-based thermographic and photothermographic formulations.

Useful nitrogen-containing organic silver salts and methods of preparing them are described in U.S. Pat. No. 6,977,139 (Hasberg et al.). Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nano-crystals comprising a silver salt of a nitrogen-containing heterocyclic compound containing an imino group, and a silver salt comprising a silver salt of a mercaptotriazole. Such co-precipitated salts are described in U.S. Pat. No. 7,008,748 (Hasberg et al.). The above patents are incorporated herein by reference.

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.001 to about 0.2 mol/$m^2$ of the dry photothermographic material (preferably from about 0.01 to about 0.05 mol/$m^2$).

The total amount of silver (from all silver sources) in the thermographic and photothermographic materials is generally at least 0.002 mol/$m^2$, preferably from about 0.01 to about 0.05 mol/$m^2$, and more preferably from about 0.01 to about 0.02 mol/$m^2$. In other aspects, it is desirable to use total silver (from both silver halide and reducible silver salts) at a coating weight of less than 2.3 g/$m^2$ and preferably at least 1 but less than 2 g/$m^2$.

Reducing Agents

The reducing agent (or reducing agent composition comprising two or more components) for the source of reducible silver ions is a compound (preferably an organic material) that can reduce silver(I) ion to metallic silver. The "reducing agent" is sometimes called a "developer" or "developing agent".

When a silver benzotriazole silver source is used, ascorbic acid reducing agents are preferred. An "ascorbic acid" reducing agent (also referred to as a developer or developing agent) means ascorbic acid, complexes, and derivatives thereof. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium, or others known in the art), endiol type ascorbic acid, an enaminol type ascorbic acid, a thioenol type ascorbic acid, and an enamin-thiol type ascorbic acid, as described in EP 0 573 700A1 (Lingier et al.), EP 0 585 792A1 (Passarella et al.), EP 0 588 408A1 (Hieronymus et al.), U.S. Pat. Nos. 2,688,549 (James et al.), 5,089,819 (Knapp), 5,278,035 (Knapp), 5,376,510 (Parker et al.), 5,384,232 (Bishop et al.), and 5,498,511 (Yamashita et al.), Japanese Kokai 7-56286 (Toyoda), and Research Disclosure, item 37152, March 1995. Mixtures of these developing agents can be used if desired.

Additionally useful are the ascorbic acid reducing agents described in copending and commonly assigned U.S. Patent Application Publication 2005/0164136 (Ramsden et al.). Also useful are the solid particle dispersions of certain ascorbic acid esters that are prepared in the presence of a particle growth modifier that are described in U.S. Patent Application Publication 2006/0051714 (Brick et al.). Both of these published applications are incorporated herein by reference.

When a silver carboxylate silver source is used in a photothermographic material, one or more hindered phenol or hindered bis-phenol reducing agents are preferred. In some instances, the reducing agent composition comprises two or more components such as a hindered phenol or hindered bis-phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substitutent located ortho to the hydroxy group.

One type of hindered phenol reducing agents are hindered phenols and hindered naphthols. This type of hindered phenol includes, for example, 2,6-di-t-butyl-4-methylphenol, 2,6-di-t-butyl-4-benzylphenol, 2-benzyl-4-methyl-6-t-butylphenol, 2,4-dimethyl-6-(1'-methylcyclohexyl)phenol, and 3,5-bis(1,1-dimethylethyl)-4-hydroxy-benzenepropanoic acid 2,2-bis[[3-[3,5-bis(1,1-dimethylethyl)-4-hydroxyphenyl]-1-oxopropoxy]methyl]-1,3-propanediyl ester (IRGANOX® 1010).

Another type of hindered phenol reducing agent are hindered bis-phenols. "Hindered bis-phenols" contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl)methanes, bis(hydroxyphenyl)-methanes bis(hydroxyphenyl)ethers, bis(hydroxyphenyl)sulfones, and bis(hydroxyphenyl)thioethers, each of which may have additional substitutents.

Preferred hindered bis-phenol reducing agents are bis(hydroxy-phenyl)methanes such as, bis(2-hydroxy-3-t-butyl-5-methylphenyl)methane, 1,1'-bis(2-hydroxy-3,5-dimethylphenyl)-3,5,5-trimethylhexane bis[2-hydroxy-3-(1-methylcyclohexyl)-5-methylphenyl)methane, 2,6-bis[(2-hydroxy-3,5-dimethylphenyl)methyl]-4-methylphenol, 1,1'-bis(2-hydroxy-3,5-dimethyl-phenyl)isobutane, and 2,6-bis[(2-hydroxy-3,5-dimethylphenyl)methyl]-4-methylphenol. Such hindered bis-phenol compounds also have at least one substitutent ortho to the hydroxyl group and are often referred to as "hindered ortho-bis-phenols".

Additional useful reducing agents include bis-phenols having non-aromatic cyclic groups attached to the linking methylene group as described for example, in U.S. Pat. No. 6,699,649 (Nishijima et al.), bis-phenols having cycloaliphatic or alkylene groups attached to the linking methylene group as described for example in U.S. Patent Application Publication 2005/0221237 (Sakai et al.), and bis-phenols having secondary or tertiary substitutents on the phenol rings as described for example, in U.S. Pat. No. 6,485,898 (Yoshioka et al.).

Particularly useful reducing agents are bis-phenol developers incorporating bicyclic and tricyclic substitutents ortho to the hydroxyl group on the aromatic rings (ortho-bicyclic or tricyclic substituted bis-phenol developers). Such reducing agents are described in copending and commonly assigned U.S. Ser. No. 11/351,593 (filed on Feb. 10, 2006 by Lynch, Ramsden, Hansen, and Ulrich) that is incorporated herein by reference.

Mixtures of hindered phenol reducing agents can be used if desired, such as the mixture of a hindered phenol and a hindered bis-phenol described in U.S. Pat. No. 6,413,712 (Yoshioka et al.) and 6,645,714 (Oya et al.).

Additional reducing agents include the bis-phenol-phosphorous compounds described in U.S. Pat. No. 6,514,684 (Suzuki et al), the bis-phenol, aromatic carboxylic acid, hydrogen bonding compound mixture described in U.S. Pat. No. 6,787,298 (Yoshioka), the compounds that can be one-electron oxidized to provide a one-electron oxidation product that releases one or more electrons as described in U.S. Patent Application Publication 2005/0214702 (Ohzeki), and the substituted hydrazines including the sulfonyl hydrazides described in U.S. Pat. No. 5,464,738 (Lynch et al.). Still other useful reducing agents are described in U.S. Pat. Nos. 3,074,809 (Owen), 3,080,254 (Grant, Jr.), 3,094,417 (Workman), 3,887,417 (Klein et al.), 4,030,931 (Noguchi et al.), and 5,981,151 (Leenders et al.). All of these patents are incorporated herein by reference.

Reducing agents are also described in U.S. Pat. Nos. 6,958,209 (Morita et al.) and 6,800,431 (Miura et al.), and in U.S. Patent Application Publications 2003/0143500 (Oyamada et al.), 2004/0063050 (Nakamura et al.), 2004/0152023 (Okutsu et al.), 2004/0202970 (Sakai et al.), and 2005/0221237 (noted above).

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 6,387,605 (Lynch et al.). Additional classes of reducing agents that can be used as co-developer reducing agents are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). Yet another class of co-developers includes substituted acrylonitrile compounds such as the compounds identified as HET-01 and HET-02 in U.S. Pat. No. 5,635,339 (Murray) and CN-01 through CN-13 in U.S. Pat. No. 5,545,515 (Murray et al.). All of the patents above are incorporated herein by reference.

Various contrast enhancing agents can be added. Such materials are useful for preparing printing plates and duplicating films useful in graphic arts, or for nucleation of medical diagnostic films. Examples of such agents are described in U.S. Pat. Nos. 6,150,084 (Ito et al.), 6,620,582 (Hirabayashi), and 6,764,385 (Watanabe et al.). Certain contrast enhancing agents are preferably used in some photothermographic materials with specific co-reducing agents. Examples of useful contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene compounds in which the benzene nucleus is substituted by no more than two hydroxy groups which are present in 2,3-position on the nucleus and have in the 1-position of the nucleus a substitutent linked to the nucleus by means of a carbonyl group. Compounds of this type include 2,3-dihydroxy-benzoic acid, and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substitutent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, and phenyl-(3,4-dihydroxyphenyl)ketone. 3,4-Dihydroxy-benzonitrile is also useful. Such compounds are described, for example, in U.S. Pat. No. 5,582,953 (Uyttendaele et al.).

Still another useful class of reducing agents includes polyhydroxy spiro-bis-indane compounds described as photographic tanning agents in U.S. Pat. No. 3,440,049 (Moede).

Aromatic di- and tri-hydroxy reducing agents can also be used in combination with hindered phenol reducing agents and further in combination with one or more high contrast co-developing agents and co-developer contrast-enhancing agents).

The reducing agent (or mixture thereof) described herein is generally present as 1 to 15% (dry weight) of the emulsion layer. In multilayer constructions, if the reducing agent is added to a layer other than an emulsion layer, slightly higher proportions, of from about 2 to 20 weight % may be more desirable. Also, the reducing agent (or mixture thereof) described herein is generally present in an amount of at least 0.10 and up to and including 0.50 mol/mol of total silver, and preferably in an amount of from about 0.10 to about 0.30 mol/mol of total silver. Co-developers may be present generally in an amount of from about 0.001% to about 1.5% (dry weight) of the emulsion layer coating.

Thus, in preferred embodiments, the thermally developable material is a photothermographic material comprising a photosensitive silver bromide or silver iodobromide, a hydrophobic binder, a non-photosensitive source of reducible silver ions that is a silver salt of an organic carboxylic acid, and a reducing agent composition comprising a hindered phenol, a hindered bisphenol, or a combination thereof.

Other Addenda

The thermally developable materials can also contain other additives such as shelf-life stabilizers, antifoggants, contrast enhancers (described above), development accelerators, acutance dyes, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. Nos. 2,131,038 (Brooker) and 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. Nos. 2,566,263 (Trirelli) and 2,597,915 (Damshroder) and the heteroaromatic mercapto compounds or heteroaromatic disulfide compounds described in EP 0 559 228B1 (Philip et al.), all of which are incorporated herein by reference.

Heteroaromatic mercapto compounds are most preferred. Preferred heteroaromatic mercapto compounds include 2-mercaptobenzimidazole, 2-mercapto-5-methylbenzimidazole, 2-mercaptobenzothiazole and 2-mercapto-benzoxazole, and mixtures thereof. A heteroaromatic mercapto compound is generally present in an emulsion layer in an amount of at least 0.0001 mole (preferably from about 0.001 to about 1.0 mole) per mole of total silver in the emulsion layer.

In addition to the supersensitizers described above, large cyclic compounds featuring a heteroatom as disclosed in U.S. Pat. No. 6,475,710 (Kudo et al.) may be used as a supersensitizer.

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), the 1,3-diaryl-substituted urea compounds described copending and commonly assigned U.S. Ser. No. 11/284,928 (filed Nov. 22, 2005 by Hunt and Sakizadeh), and tribromomethylketones as described in EP 0 600 587A1 (Oliff et al.). All of these documents are incorporated herein by reference.

Additives useful as stabilizers for improving dark stability and desktop print stability are the various boron compounds described in U.S. patent application Publication 20060141404 (Philip et al.) that is incorporated herein by reference. The boron compounds are preferably added in an amount of from about 0.010 to about 0.50 g/m$^2$.

Also useful as stabilizers for improving the post-processing print stability of the imaged material to heat during storage (known as "hot-dark print stability") are the arylboronic acid compounds described in copending and commonly assigned U.S. Ser. No. 11/351,773 (filed on Feb. 10, 2006 by Chen-Ho and Sakizadeh) that is incorporated herein by reference.

The photothermographic materials preferably also include one or more polyhalogen stabilizers that can be represented by the formula Q-$(Y)_n$—$C(Z_1Z_2X)$ wherein, Q represents an alkyl, aryl (including heteroaryl) or heterocyclic group, Y represents a divalent linking group, n represents 0 or 1, $Z_1$ and $Z_2$ each represents a halogen atom, and X represents a hydrogen atom, a halogen atom, or an electron-withdrawing group. Particularly useful compounds of this type are polyhalogen stabilizers wherein Q represents an aryl group, Y represents (C═O) or $SO_2$, n is 1, and $Z_1$, $Z_2$, and X each represent a bromine atom. Examples of such compounds containing —$SO_2CBr_3$ groups are described in U.S. Pat. Nos. 3,874,946 (Costa et al.), 5,369,000 (Sakizadeh et al.), 5,374,514 (Kirk et al.), 5,460,938 (Kirk et al.), 5,464,737 (Sakizadeh et al.) and 5,594,143 (Kirk et al.), and in U.S. Published Patent Application 2003/0134238 (Yoshioka), all of which are incorporated herein by reference. Examples of such compounds include, but are not limited to, 2-tribromomethylsulfonylbenzene 2-tribromo-methylsulfonylpyridine, 2-tribromomethylsulfonylquinoline, and 2-tribromomethylsulfonyl-5-methyl-1,3,4-thiadiazole. The polyhalogen stabilizers can be present in one or more layers in a total amount of from about 0.005 to about 0.01 mol/mol of total silver, and preferably from about 0.01 to about 0.05 mol/mol of total silver.

Stabilizer precursor compounds capable of releasing stabilizers upon application of heat during imaging can also be used, as described in U.S. Pat. Nos. 5,158,866 (Simpson et al.), 5,175,081 (Krepski et al.), 5,298,390 (Sakizadeh et al.), and 5,300,420 (Kenney et al.). Also useful are the blocked aliphatic thiol compounds described in U.S. Pat. No. 7,169,543 (Ramsden et al.) are incorporated herein by reference.

In addition, certain substituted-sulfonyl derivatives of benzo-triazoles may be used as stabilizing compounds as described in U.S. Pat. No. 6,171,767 (Kong et al.).

"Toners" or derivatives thereof that improve the image are desirable components of the thermally developable materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the photothermographic or thermographic emulsion layer or in an adjacent non-imaging layer.

Compounds useful as toners are described in U.S. Pat. Nos. 3,080,254 (Grant, Jr.), 3,847,612 (Winslow), 4,123,282 (Winslow), 4,082,901 (Laridon et al.), 3,074,809 (Owen), 3,446,648 (Workman), 3,844,797 (Willems et al.), 3,951,660 (Hagemann et al.), 5,599,647 (Defieuw et al.) and GB 1,439,478 (AGFA).

Additional useful toners are substituted and unsubstituted mercaptotriazoles as described in U.S. Pat. Nos. 3,832,186 (Masuda et al.), 6,165,704 (Miyake et al.), 5,149,620 (Simpson et al.), 6,713,240 (Lynch et al.), and 6,841,343 (Lynch et al.), all of which are incorporated herein by reference.

Phthalazine and phthalazine derivatives [such as those described in U.S. Pat. No. 6,146,822 (Asanuma et al.), incorporated herein by reference], phthalazinone, and phthalazinone derivatives are also useful toners.

A combination of one or more hydroxyphthalic acids and one or more phthalazinone compounds can be included in the thermographic materials. Hydroxyphthalic acid compounds have a single hydroxy substitutent that is in the meta position to at least one of the carboxy groups. Preferably, these compounds have a hydroxy group in the 4-position and carboxy groups in the 1- and 2-positions. The hydroxyphthalic acids can be further substituted in other positions of the benzene ring as long as the substitutents do not adversely affect their intended effects in the thermographic material. Mixtures of hydroxyphthalic acids can be used if desired.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

This combination facilitates obtaining a stable bluish-black image after processing. In preferred embodiments, the molar ratio of hydroxyphthalic acid to phthalazinone is sufficient to provide an a* value more negative than −2 (preferably more negative than −2.5) at an optical density of 1.2 as defined by the CIELAB Color System when the material has been imaged using a thermal print-head from 300 to 400° C. for less than 50 milliseconds (50 msec) and often less than 20 msec. In preferred embodiments, the molar ratio of phthalazinone is to hydroxyphthalic acid about 1:1 to about 3:1. More preferably the ratio is from about 2:1 to about 3:1.

In addition, the imaged material provides an image with an a* value more negative than −1 at an optical density of 1.2 as defined by the CIELAB Color System when the above imaged material is then stored at 70° C. and 30% RH for 3 hours.

The direct thermographic materials may also include one or more additional polycarboxylic acids (other than the hydroxyphthalic acids noted above) and/or anhydrides thereof that are in thermal working relationship with the sources of reducible silver ions in the one or more thermographic layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (Emmers et al.).

The addition of development accelerators that increase the rate of image development and allow reduction in silver coating weight is also useful. Suitable development accelerators include phenols, naphthols, and hydrazine-carboxamides. Such compounds are described, for example, in Y. Yoshioka, K. Yamane, T. Ohzeki, *Development of Rapid Dry Photothermographic Materials with Water-Base Emulsion Coating Method*, AgX 2004: The International Symposium on Silver Halide Technology "At the Forefront of Silver Halide Imaging", Final Program and Proceedings of IS&T and SPSTJ, Ventura, Calif., Sep. 13-15, 2004, pp. 28-31, Society for Imaging Science and Technology, Springfield, Va., U.S. Pat. No. 6,566,042 (Goto et al.), and U.S. Patent Application Publications 2004/234906 (Ohzeki et al.), 2005/048422 (Nakagawa), 2005/118542 (Mori et al.), and 2006/0014111 (Goto). All of the above documents are incorporated herein by reference.

Thermal solvents (or melt formers) can also be used, including combinations of such compounds (for example, a combination of succinimide and dimethylurea). Thermal solvents are compounds which are solids at ambient temperature but which melt at the temperature used for processing. The thermal solvent acts as a solvent for various components of the heat-developable photosensitive material, it helps to accelerate thermal development and it provides a medium for diffusion of various materials including silver ions and/or complexes, and reducing agents. Known thermal solvents are disclosed in U.S. Pat. Nos. 3,438,776 (Yudelson), 5,064,753 (noted above) 5,250,386 (Aono et al.), 5,368,979 (Freedman et al.), 5,716,772 (Taguchi et al.), and 6,013,420 (Windender). Thermal solvents are also described in U.S. Pat. No. 7,169,544 (Chen-Ho et al.) All of the above patents are incorporated herein by reference.

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures. For example, useful phosphors are described in numerous references relating to fluorescent intensifying screens as well as U.S. Pat. Nos. 6,440,649 (Simpson et al.) and 6,573,033 (Simpson et al.) that are directed to photothermographic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Patent Application Publication 2005/0233269 (Simpson et al.). The above patents and patent application publication are incorporated herein by reference.

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/$m^2$. While the phosphors can be incorporated into any imaging layer on one or both sides of the support, it is preferred that they be in the same layer(s) as the photosensitive silver halide(s) on one or both sides of the support.

Binders

The photosensitive silver halide (if present), the non-photosensitive source of reducible silver ions, the reducing agent composition, and any other imaging layer additives are generally combined with one or more binders that are generally hydrophobic or hydrophilic in nature. Thus, either aqueous or organic solvent-based formulations can be used to prepare the thermally developable materials. Mixtures of either or both types of binders can also be used. It is preferred that the binder be selected from predominantly hydrophobic polymeric materials (at least 50 dry weight % of total binders).

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral, polyvinyl acetal, and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, Mich.), BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, Research Disclosure, item 38957, noted above). Cationic starches can also be used as a peptizer for tabular silver halide grains as described in U.S. Pat. Nos. 5,620,840 (Maskasky) and 5,667,955 (Maskasky).

One embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly(olefin), and the like. As the polymers above, usable are straight chain polymers, branched polymers, or crosslinked polymers. Also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image-forming layer, and those having too large molecular weight are also not preferred because the filming properties result poor. Further, crosslinking polymer latexes are particularly preferred for use. Specific examples of preferred polymer latexes include:

- Latex of methyl methacrylate (70) -ethyl acrylate (27) -methacrylic acid (3).
- Latex of methyl methacrylate (70) -2-ethylhexyl acrylate (20) -styrene (5) -acrylic acid (5).
- Latex of styrene (50)-butadiene (47)-methacrylic acid (3).
- Latex of styrene (68)-butadiene (29)-acrylic acid (3).
- Latex of styrene (71)-butadiene (26)-acrylic acid (3).
- Latex of styrene (70)-butadiene (27)-itaconic acid (3).
- Latex of styrene (75)-butadiene (24)-acrylic acid (1).
- Latex of styrene (60)-butadiene (35)-divinylbenzene (3)-methacrylic acid (2).
- Latex of styrene (70)-butadiene (2.5)-divinylbenzene (2)-acrylic acid (3).
- Latex of vinyl chloride (50)-methyl methacrylate (20)-ethyl acrylate (20)-acrylonitrile (5)-acrylic acid (5).
- Latex of vinylidene chloride (85)-methyl methacrylate (5)-ethyl acrylate (5)-methacrylic acid (5).
- Latex of ethylene (90)-methacrylic acid (10).
- Latex of styrene (70)-2-ethylhexyl acrylate (27)-acrylic acid (3).
- Latex of methyl methacrylate (63)-ethyl acrylate (35)-acrylic acid (2).
- Latex of styrene (70.5)-butadiene (26.5)-acrylic acid (3).
- Latex of styrene (69.5)-butadiene (27.5)-acrylic acid (3)

The numbers in parenthesis represent weight %. The polymer latexes above are commercially available. They may be used alone, or may be used by blending two or more types.

Particularly preferable as the polymer latex for use as a binder is that of styrene-butadiene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Moreover, the polymer latex contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is the same as that described above.

Preferred latexes include styrene (50)-butadiene (47)-methacrylic acid (3), styrene (60)-butadiene (35)-divinylbenzene-methyl methacrylate (3)-methacrylic acid (2), styrene (70.5)-butadiene (26.5)-acrylic acid (3) and commercially available LACSTAR-3307B, 7132C, and Nipol Lx416. Such latexes are described in U.S. Patent Application Publication 2005/0221237 (Sakai et al.) that is incorporated herein by reference.

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77-8.

Where the proportions and activities of the thermally developable materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that the binder not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the thermally developable materials include at least 50 weight % hydrophobic binders in both imaging and non-imaging layers on both sides of the support (and particularly the imaging side of the support).

Support Materials

The thermally developable materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet). Both of the above patents are incorporated herein by reference.

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Thermographic and Photothermographic Formulations and Constructions

An organic solvent-based coating formulation for the thermographic and photothermographic emulsion layer(s) can be prepared by mixing the various components with one or more binders in a suitable organic solvent system that usually includes one or more solvents such as toluene, 2-butanone (methyl ethyl ketone), acetone, methanol, or tetrahydrofuran, or mixtures thereof. Methyl ethyl ketone is a preferred coating solvent.

Alternatively, the desired imaging components can be formulated with a hydrophilic binder (such as gelatin, or a gelatin-derivative), or a hydrophobic water-dispersible polymer latex (such as a styrene-butadiene latex) in water or water-organic solvent mixtures to provide aqueous-based coating formulations.

Thermally developable materials can contain plasticizers and lubricants such as poly(alcohols) and diols as described in U.S. Pat. No. 2,960,404 (Milton et al.), fatty acids or esters as described in U.S. Pat. Nos. 2,588,765 (Robijns) and 3,121,060 (Duane), and silicone resins as described in GB 955,061 (DuPont). The materials can also contain inorganic and organic matting agents as described in U.S. Pat. Nos. 2,992,101 (Jelley et al.) and 2,701,245 (Lynn). Polymeric fluorinated surfactants may also be useful in one or more layers as described in U.S. Pat. No. 5,468,603 (Kub).

The photothermographic materials may also include a surface protective layer over the one or more emulsion layers. Layers to reduce emissions from the material may also be present, including the polymeric barrier layers described in U.S. Pat. Nos. 6,352,819 (Kenney et al.), 6,352,820 (Bauer et al.), 6,420,102 (Bauer et al.), 6,667,148 (Rao et al.), and 6,746,831 (Hunt), all incorporated herein by reference.

U.S. Pat. No. 6,436,616 (Geisler et al.), incorporated herein by reference, describes various means of modifying photothermographic materials to reduce what is known as the "woodgrain" effect, or uneven optical density.

Layers to promote adhesion of one layer to another are also known, as described in U.S. Pat. Nos. 4,741,992

(Przezdziecki), 5,804,365 (Bauer et al.), and 5,891,610 (Bauer et al.). Adhesion can also be promoted using specific polymeric adhesive materials as described in U.S. Pat. No. 5,928,857 (Geisler et al.).

Layers to reduce emissions from the material may also be present, including the polymeric barrier layers described in U.S. Pat. Nos. 6,352,819 (Kenney et al.), 6,352,820 (Bauer et al.), 6,420,102 (Bauer et al.), 6,667,148 (Rao et al.), and 6,746,831 (Hunt), all incorporated herein by reference.

Mottle and other surface anomalies can be reduced by incorporation of a fluorinated polymer as described in U.S. Pat. No. 5,532,121 (Yonkoski et al.) or by using particular drying techniques as described, for example in U.S. Pat. No. 5,621,983 (Ludemann et al.).

The thermally developable materials can also include one or more antistatic or conductive layers on the frontside of the support. Such layers may contain nanoparticles of conductive metal compounds such as metal oxides, or other conventional antistatic agents known in the art for this purpose such as soluble salts (for example, chlorides or nitrates), evaporated metal layers, or ionic or conductive polymers such as polythiophenes and those described in U.S. Pat. Nos. 2,861,056 (Minsk) and 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described below and in U.S. Pat. No. 5,368,995 (Christian et al.), electrically-conductive metal-containing particles dispersed in a polymeric binder such as those described in U.S. Pat. Nos. 5,547,821 (Melpolder et al.) and 7,056,651 (Simpson et al.), and fluorochemicals that are described in numerous publications.

The photothermographic and thermographic materials may also usefully include a magnetic recording material as described in Research Disclosure, Item 34390, November 1992, or a transparent magnetic recording layer such as a layer containing magnetic particles on the underside of a transparent support as described in U.S. Pat. No. 4,302,523 (Audran et al.).

To promote image sharpness, photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoats. Additionally, one or more acutance dyes may be incorporated into one or more frontside imaging layers.

Dyes useful as antihalation and acutance dyes include squaraine dyes as described in U.S. Pat. Nos. 5,380,635 (Gomez et al.), and 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.), all incorporated herein by reference.

It is also useful to employ compositions including acutance or antihalation dyes that will decolorize or bleach with heat during processing, as described in U.S. Pat. Nos. 5,135,842 (Kitchin et al.), 5,266,452 (Kitchin et al.), 5,314,795 (Helland et al.), and 6,306,566, (Sakurada et al.), and Japanese Kokai 2001-142175 (Hanyu et al.) and 2001-183770 (Hanye et al.). Useful bleaching compositions are also described in Japanese Kokai 11-302550 (Fujiwara), 2001-109101 (Adachi), 2001-51371 (Yabuki et al.), and 2000-029168 (Noro). All of the noted publications are incorporated herein by reference.

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. Nos. 4,196,002 (Levinson et al.), 5,652,091 (Perry et al.), and 5,672,562 (Perry et al.), all incorporated herein by reference. Examples of such heat-bleachable compositions are described in U.S. Pat. Nos. 6,455,210 (Irving et al.), 6,514,677 (Ramsden et al.), and 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

It is preferable for the photothermographic material to include one or more radiation absorbing substances that are generally incorporated into one or more photothermographic layer(s) to provide a total absorbance of all layers on the imaging side of the support (or an optical density) of at least 0.1 (preferably of at least 0.6) at the exposure wavelength of the photothermographic material. It is also desired that the total absorbance (or optical density) at the exposure wavelength for all layers on the backside (non-imaging) side of the support be at least 0.2.

The thermally developable formulations can be coated by various coating procedures including wire wound rod coating, dip coating, air knife coating, curtain coating, slide coating, slot-die coating, or extrusion coating using hoppers of the type described in U.S. Pat. No. 2,681,294 (Beguin). Layers can be coated one at a time, or two or more layers can be coated simultaneously by the procedures described in U.S. Pat. Nos. 2,761,791 (Russell), 4,001,024 (Dittman et al.), 4,569,863 (Keopke et al.), 5,340,613 (Hanzalik et al.), 5,405,740 (LaBelle), 5,415,993 (Hanzalik et al.), 5,525,376 (Leonard), 5,733,608 (Kessel et al.), 5,849,363 (Yapel et al.), 5,843,530 (Jerry et al.), and 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5 or more, as measured by an X-rite Model 361/V Densitometer equipped with 301 Visual Optics, available from X-rite Corporation, (Granville, Mich.).

Subsequently to or simultaneously with application of the emulsion formulation to the support, a protective overcoat formulation can be applied over the emulsion formulation.

Preferably, two or more layer formulations are simultaneously applied to a support using slide coating, the first layer being coated on top of the second layer while the second layer is still wet. The first and second fluids used to coat these layers can be the same or different solvents. For example, a protective overcoat formulation can be applied simultaneously with, the application of the emulsion formulation(s) to the support. Simultaneous coating can be used to apply layers on the frontside, backside, or both sides of the support.

In other embodiments, a "carrier" layer formulation comprising a single-phase mixture of two or more polymers described below may be applied directly onto the support and thereby located underneath the emulsion layer(s) as described in U.S. Pat. No. 6,355,405 (Ludemann et al.), incorporated herein by reference. The carrier layer formulation can be simultaneously applied with application of the emulsion layer formulation(s) and any overcoat or surface protective layers.

Backside Compositions and Layers

In its simplest form, the thermally developable material comprises a polymeric support having on one side thereof (that is, the frontside or imaging side) thermographic or photothermographic imaging chemistry, and having disposed on the backside of the polymeric support, at least one buried conductive backside layer comprising an antistatic compound that includes one or more compounds from one or more of three different classes of compounds:

1) organic solvent soluble alkali metal salts of perfluorinated aliphatic carboxylic acids having 2 or 3 carbon atoms, 2) organic solvent soluble alkali metal salts of perfluorinated aliphatic sulfonates, or 3) organic solvent soluble alkali metal salts of tetrafluoroborate.

The one or more antistatic compounds are present in an amount sufficient to provide a water electrode resistivity of up to $1\times10^{12}$ ohm/sq (preferably, up to $1\times10^{11}$ ohm/sq) at 21.1° C. and 50% relative humidity. Lithium, sodium, and potassium salts are preferred, and lithium salts are most preferred for each class of compounds.

Representative antistatic compounds in the first class include but are not limited to, lithium trifluoroacetate, sodium trifluoroacetate, potassium trifluoroacetate, lithium trifluoropropionate, sodium trifluoropropionate, and potassium trifluoropropionate.

Representative antistatic compounds in the second class include but are not limited to, lithium nonafluorobutanesulfonate, lithium tridecafluoro-hexanesulfonate, lithium heptadecylfluorooctanesulfonate, sodium undecafluoro-pentanesulfonate, sodium tridecafluorohexanesulfonate, and potassium pentafluoropropanesulfonate. The organic solvent soluble alkali metal salts of perfluorinated aliphatic sulfonates preferably have 1 to 10 carbon atoms and more preferably 4 to 8 perfluorinated carbon atoms in the aliphatic chain.

Representative antistatic compounds in the third class include but are not limited to, lithium tetrafluoroborate, sodium tetrafluoroborate, and potassium tetrafluoroborate.

Of these representative compounds, the lithium, sodium, and potassium trifluoroacetates are most preferred, either alone or mixtures of two or three of them. Lithium trifluoroacetate is most preferred.

The term "buried conductive backside layer" means that the conductive layer lies between the polymeric support and has one or more additional layers coated over it. It is preferred that the "overcoat" layer be the outermost backside layer.

In one construction, where the support is a polyester resin, the buried conductive backside layer formulation comprises a single-phase mixture of two or more polymers and the antistatic compounds described herein. A preferred binder is a single-phase mixture of a polyester resin as a first polymer and a polyvinyl acetal such as polyvinyl butyral or a cellulose ester polymer such as cellulose acetate butyrate as a second polymer. A preferred polyvinyl butyral is a polyvinyl butyral having a molecular weight of at least 8,000 and less than 30,000. A preferred cellulose ester polymer is cellulose acetate butyrate (CAB) having a molecular weight of about 70,000.

The weight ratio of "first" polymer to "second" polymer in the buried conductive backside layer is generally from about 10:90 to about 60:40, and preferably from about 20:80 to about 50:50. A more preferred polymer combination is of polyester and cellulose acetate butyrate having a weight ratio of about 40:60.

The buried conductive backside layer can also include still other polymers that are not defined herein as first or second polymers. These additional polymers can be either hydrophobic polymers or organic-soluble hydrophilic polymers. Some hydrophilic polymers that may be present include, but are not limited to, proteins or polypeptides such as gelatin and gelatin derivatives, polysaccharides, gum arabic, dextrans, polyacrylamides (including polymethacrylamides), polyvinyl pyrrolidones and others that would be readily apparent to one skilled in the art.

The antistatic compounds are generally present in an amount sufficient to provide a backside water electrode resistivity (WER) of $1\times10^{12}$ ohms/sq (12 log ohm/sq) or less and preferably $1\times10^{11}$ ohms/sq (11 log ohm/sq) or less at 70° F. (21.1° C.) and 50% relative humidity as well as to provide a static decay time of less than 100 seconds (preferably 25 seconds or less) at 70° F. (21.1° C.) and 20% relative humidity. To achieve this value, the antistatic compounds generally comprise from about more than 20 and up to about 85% (preferably from about 30 to about 75%) by weight of the dry buried conductive backside layer. Thus, the weight % of the polymer mixture in the dry buried conductive backside layer is from about 15 to about 80 weight % and preferably from about 25 to about 70 weight %). Another way of defining the amount of antistatic compound is that they are generally present in the buried conductive backside layer in an amount of from about 0.02 to about 2 $g/m^2$ (preferably from about 0.2 to about 0.4 $g/m^2$) of the dry layer coating weight. Mixtures of different types of antistatic compounds can be used if desired. The optimum ratio of total binder to conductive material can vary depending upon the specific compound and binders used, the dry thickness of the buried conductive backside layer, and the dry thickness of adjacent layers. One skilled in the art would be able to determine the optimum parameters to achieve the desired conductivity and adhesion to adjacent layers and/or support.

In most preferred embodiments, it is desired that the buried conductive backside layer contribute little to haze so that the total haze of the support plus all backside layers is 15% or less, preferably 13% or less, and most preferably 10% or less, as measured using ASTM D 1003 and further described below.

It is further desired in most preferred embodiments, that the adhesion of the buried conductive backside layer to the support have a value of at least 3 as measured using ASTM D3359-92A and further described below.

The buried conductive backside layers containing the antistatic compounds described above, are generally coated out of one or more organic solvents. The organic solvents useful in the invention are hydrophobic solvents having a "clog P" value greater than or equal to 0, Such solvents include, but not limited to ketones [such as methyl ethyl ketone (2-butanone, MEK) or methyl isobutyl ketone (MIBK)], toluene, tetrahydrofuran, ethyl acetate, or any mixture of any two or more of these solvents. These hydrophobic organic solvents may contain a small amount (less than 10%, and more preferably less than 5%) of a hydrophilic organic solvent such as methanol or ethanol and less than 4% of water.

The clog P value is a calculated estimate of the octanol-water partition coefficient (P), which is a physical property used extensively to describe a chemical's lipophilic or hydrophobic properties. It is the ratio of a chemical's concentration in the octanol-phase to its concentration in the aqueous-phase of a two-phase system at equilibrium. Since measured values range from $<10^{-4}$ to $>10^{+8}$ (at least 12 orders of magnitude), the logarithm (log P) is commonly used to characterize its value. The Log Octanol-Water Partition Coefficient Program KOWWWIN© may be used to estimate the logarithmic octanol-water partition coefficient (log P) of organic compounds. This program is available from the U.S. Environmental Protection Agency via free internet download from the web-page <www.epa.gov/oppt/exposure/docs/episuitedl.htm>. KOWWIN® requires only a chemical structure to estimate log P values. Structures are entered into KOWWIN® by SMILES (Simplified Molecular Input Line Entry System) notations. The KOWWIN® program and estimation methodology were developed by W. Meylan of Syracuse Research Corporation (North Syracuse, N.Y.), and is described in W. M. Meylan and P. H. Howard, *J. Pharm. Sci.* 1995, 84, 83-92 entitled *Atom/fragment Method for Estimating Octanol-Water Partition Coefficients*. All values for "clog P" used herein were calculated using KOWWIN® Version 1.661.

The buried conductive backside layer may be relatively thin. For example, it can have a dry thickness of from about 0.05 to about 2 μm, and preferably from about 0.1 to about 1 μm. The thin buried conductive backside layers are useful as "carrier" layers. The term "carrier layer" is often used when multiple layers are coated using slide coating and the buried conductive backside layer is a thin layer adjacent to the support.

In one preferred embodiment, the buried conductive backside layer is a carrier layer containing a polymer and the one or more antistatic compounds described herein and is directly disposed on the support without the use of primer or subbing layers, or other adhesion-promoting means such as support surface treatments. Thus, the support can be used in an "untreated" and "uncoated" form when a buried conductive backside carrier layer is used. The carrier layer formulation is simultaneously applied with application of these other backside layer formulations and is thereby located underneath these other backside layers.

Optional components of the buried conductive backside layer include materials that may improve coatability or adhesion, crosslinking agents (such as diisocyanates), antihalation dyes, and shelf-aging promoters.

It is also preferred that the outermost backside layer be immediately adjacent the buried conductive backside layer. That is, there are no layers disposed between them.

In one preferred embodiment the outermost backside layer further contains one or more polysiloxanes. Polysiloxanes, also referred to as silicone fluids, are liquid compounds known for their ability to provide coatings with lubricating, mar-resistant, and antiblocking properties. Polysiloxanes may also provide such coatings with reduced coefficient of friction. Their properties are believed to be a function of low intermolecular forces between the silicone polymer chains. Polysiloxanes have the general Structure (1) below.

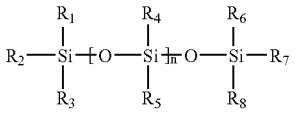

(I)

The simplest polysiloxane compounds are polydimethylsiloxanes where all R groups are methyl. Polysiloxanes can be modified with various substitutents as the terminal R groups (that is, $R_1$, $R_2$, $R_3$, $R_6$, $R_7$, and $R_8$), with various substitutents as R groups attached to silicon within the polysiloxane chain (that is $R_4$, and $R_5$), or with various substitutents in both portions. In addition, different siloxane groups, each with different substitutents can be incorporated within the polysiloxane chain. Some common representative terminal substitutent groups include methyl, hydrogen, hydroxy, hydroxyalkyl (such as vinyl, hydroxymethyl), alkylamino (such as aminopropyl), and alkylcarboxy groups (such as carboxypropyl). Preferred terminal groups include methyl and alkylamino groups. Common substitutent groups within the polysiloxane chain include alkylamino, phenyl, benzyl, perfluoroalkyl (such as trifluoropropyl), and alkyl groups (such as methyl, ethyl, butyl, hexyl, octyl, and octadecyl groups). The alkyl groups may be further substituted, such as with cycloalkyl and epoxycycloalkyl groups. Preferred substitutent groups within the polysiloxane chain include diphenyl, phenylmethyl, dimethyl, a mixture of phenylmethyl and dimethyl groups, or a mixture of (epoxycyclohexylethyl)methyl and dimethyl groups.

It is preferred that the polysiloxanes be soluble in organic solvents and particularly those organic solvents used in coating the outermost backside layer. A preferred solvent is MEK (methyl ethyl ketone) and mixtures of MEK with less than 50% of other organic solvents such as methanol. It is further preferred that in Structure (I) "n" be an integer such that the polysiloxanes have a molecular weight greater than about 25,000 and preferably from about 25,000 to about 35,000.

The polysiloxanes are present in the outermost backside layer in an amount of at least 0.5%, preferably from about 0.5 to about 6 weight %, and more preferably from about 1.5 to about 6 weight % based on the dry weight of the binder.

Polysiloxanes can be obtained from a number of commercial sources such as Aldrich Chemical Company (Milwaukee, Wis.), Dow Corning (Midland, Mich.) (http://www.dowcoming.com), Gelest Inc. (Morrisville, Pa.) (http://www.gelest.com), Polymer Products (Ontario, N.Y.), and United Chemical Technologies (Bristol, Pa.).

In another embodiment, the outermost backside layer also contains one or more types of wax particulates or polytetrafluoroethylene particulates or mixtures (or blends) thereof. These particulates are irregular in shape, have an average size in the largest dimension of 15 μm or less, preferably of 10 μM or less, and a softening temperature of 93° C. or greater. Preferably the particulates have an average size in the largest dimension of from about 0.5 to about 10 μm and more preferably from about 1 to about 8 μm. The particulates are present in the outermost backside layer in an amount of at least 0.1%, preferably from about 0.2 to about 3 weight %, and more preferably from about 0.3 to about 2 weight % based on the dry weight of the binder. Many of the useful particulates include polymerized units of ethylene, propylene, or both, or derivatives thereof.

Various types of wax and polytetrafluoroethylene particulates can be obtained from a number of commercial sources. One particular source of these types of particulates is sold under the trade-name SLIP-AYD® by Elementis Specialties (Hightstown, N.J.) Representative useful particulates include:

The use of polysiloxanes in conjunction with wax or polytetra-fluoroethylene particulates in backside overcoat layers for thermally developable materials is described in co-pending and commonly assigned U.S. Ser. No. 11/311,547 (filed Dec. 19, 2005 by Kub, LaBelle, and Ludemann) that is incorporated herein by reference.

In another preferred embodiment the outermost backside layer also comprises amorphous silica particles. It is more preferred that such amorphous silica particles have a narrow particle size distribution. The use of amorphous silica particles having a narrow particle size distribution in the outermost backside layer provides thermally developable imageable materials with lower haze while maintaining the surface roughness necessary to reduce blocking and provide efficient feeding into image processors. Further details describing the use of amorphous silica particles in outermost backside layers of thermally developable materials not containing polysiloxanes is described in U.S. Pat. No. 7,105,284 (Philip et al.) that is incorporated herein by reference.

The roughness obtained from the amorphous silica particles is dependent on the diameter of the particles, the loading, and the thickness of the binder layer to which they are added. We believe this a function of the amount of the amorphous silica particle that is above the surface of the outermost backside layer. For example, for an outermost backside layer dry thickness of from 1 to 1.5 μm, preferred particles are those with a mean volume diameter from about 4 to about 8.5 μm with a standard deviation of less than 2 μm. The amorphous silica particles can be employed at a coating weight of about 20 to about 100 mg/m$^2$ and preferably from about 30 to about 70 mg/m$^2$. It is preferred that the mean volume diameter of the amorphous silica be at least 3 μm greater than the dry thickness of the outermost backside layer. It is more preferred that the amorphous silica particles extend at least 5 μm above the surface of the dried outermost backside layer. It is also preferred that the standard deviation divided by the mean particle diameter is less than 0.28 μm.

In a further embodiment, the outermost backside layer can contain a smectite clay that has been modified with a quaternary ammonium compound (also known as an ammonium salt). A preferred smectite clay is montmorillonite, an aluminum magnesium silicate clay having the approximate formula $R^+_{0.33}(Al,Mg)_2Si_4O_{10}(OH)_2.n(H_2O)$, where $R^+$ includes one or more of the cations $Na^+$, $K^+$, $Mg^{2+}$, $NH_4^+$, and $Ca^{2+}$ and possibly others. (See *Merck Index*, Ninth Ed., Merck & Co., Rahway, N.J.). It can be modified by replacing the $R^+$ groups. The optional smectite clays useful in this invention have been modified by exfoliation and exchange of a portion of the $R^+$ groups with various quaternary ammonium compounds. This allows the clays to be more easily dispersed in organic solvents. Such clays are commercially available from Southern Clay Products under the trade-names CLOISITE® and CLAYTONE®. In many CLOISITE® clays the ammonium compounds are hydrogenated tallow amines. Further details of such modified clays are provided in U.S. Pat. Nos. 7,018,787 (Ludemann et al.) and 7,153,636 (Ludemann et al.) that are incorporated herein by reference.

When used, the modified smectite clay is generally present in the outermost backside layer in an amount of from about 0.5 to about 5 weight %, and preferably from about 0.5 to about 3 weight %, based on the total dry binder weight. Alternatively, the modified smectite clay can replace a portion of the wax or polytetrafluoroethylene particulates depending on the abrasion resistance, amount of haze, and other physical properties desired. Although the smectite clay can replace from 0 to 99% by weight of these particulates it is preferred that it replace no more than 50% by weight.

The outermost backside layer may also include other addenda commonly added to such formulations including, but not limited to: shelf life extenders, antihalation dyes, colorants to control tint and tone, magnetic recording materials to record data, UV absorbing materials to improve light-box stability, and coating aids such as surfactants to achieve high quality coatings, all in conventional amounts. The outermost backside layer may also include one or more image stabilizing compounds. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al), and GB 1,565,043 (Fuji Photo). All of these patents and patent applications are incorporated herein by reference.

The outermost backside layer generally has a dry thickness of from about 0.5 to about 5 μm, preferably from about 0.5 to about 1.5 μm. Stated another way, the outermost backside layer generally has a dry coating weight of from about 0.5 to about 4 g/m$^2$ and preferably from about 0.5 to about 2 g/m$^2$.

The ratio of dry thickness of the buried conductive backside layer to the dry thickness of the outermost backside layer is from about 0.01:1 to about 2:1 and preferably from about 0.1:1 to about 1:1.

As noted above the thermally developable materials have at least one buried conductive backside layer comprising the antistatic compounds described above on the backside (non-imaging side) of the polymeric support along with one or more additional backside overcoat layers. This outermost backside layer can additionally comprise one or more of the polysiloxane, modified smectite clays, amorphous silica particles, and wax or polytetrafluoro-ethylene particulates, described above, or any combination thereof.

The relationship of the buried conductive backside layer(s), and the polymeric support or layer or layers immediately adjacent is important because the types of polymers and binders in these layers are designed to provide excellent adhesion to one another as well as acceptably dispersing the components of each layer to facilitate coating.

The layer directly disposed over the buried conductive backside layer is known herein as a "backside overcoat" layer, and can also be known as a "backside protective" layer. Most preferably it is the "outermost backside" layer and contains one or more of the polysiloxane, modified smectite clays, amorphous silica particles, and wax or polytetrafluoroethylene particulates described above. This backside overcoat layer comprises a film-forming polymer. The buried conductive backside layer immediately underneath comprises the one or more antistatic compounds in a mixture of two or more polymers that includes a "first" polymer serving to promote adhesion of the buried conductive backside layer directly to the polymeric support, and a "second" polymer that is different than and forms a single-phase mixture with the first polymer and that promotes adhesion to the backside overcoat layer. For example, when the support is a polyester film, then a preferred mixture of polymers in the buried conductive backside layer is a single-phase mixture of a polyester resin and a polyvinyl acetal such as a polyvinyl butyral or cellulose ester polymer such as cellulose acetate butyrate.

It is preferred that the film-forming polymer of the backside overcoat layer be of the same class or at least be compatible with the second polymer of the buried conductive backside layer. Preferred film-forming polymers of the backside overcoat layer are polyvinyl acetals such as polyvinyl butyral, or cellulose ester polymers. Cellulose ester polymers such as cellulose acetate butyrate are more preferred. Cellulose acetate butyrate is most preferred.

In another embodiment, the buried conductive backside layer is disposed between the backside overcoat layer and an "undercoat" layer directly adhering to the support. In this embodiment, the backside overcoat layer is again directly above the buried conductive backside layer and is again known herein as a backside overcoat layer, an "interlaye", or a "protective" layer. This backside overcoat layer comprises a film-forming polymer. It can be the outermost backside layer or have further layer(s) disposed thereon. Preferably it is the outermost backside layer and contains one or more of the polysiloxane, modified smectite clays, amorphous silica particles, and wax or polytetrafluoroethylene particulates described above. The buried conductive backside layer immediately beneath the backside overcoat layer comprises the one or more antistatic compounds dissolved in polymer that serves to promote adhesion of the buried conductive backside layer to the backside overcoat layer as well as to the undercoat layer immediately beneath it. This adhesion promoting undercoat layer, directly adhered to the support, comprises a mixture of two or more polymers. The first polymer serves to promote adhesion of the undercoat layer directly to the polymeric support. The second polymer serves to promote adhesion of the undercoat layer to the buried conductive backside layer.

It is preferred that the film-forming polymer of the backside overcoat layer be of the same class or at least be compatible with the polymer of the buried conductive backside layer. It is also preferred that the polymer of the buried conductive backside layer be of the same class or compatible with the second polymer of the undercoat layer.

It is preferred that the undercoat, adhesion-promoting, layer use a single phase mixture of a polyester resin as a "first" polymer and a polyvinyl acetal such as polyvinyl butyral or a cellulose ester polymer such as cellulose acetate butyrate as a "second" polymer".

In yet another embodiment, the buried conductive backside layer is disposed between a backside overcoat layer and an undercoat layer directly adhering to the support. In this embodiment, the backside overcoat layer is again directly above the buried conductive backside layer and is again known herein as a backside overcoat layer, an "interlayer" or a "protective" layer. This backside overcoat layer comprises a film-forming polymer. It can be the outermost backside layer or have further layer(s) disposed thereon. Preferably it is the outermost backside layer and contains the polysiloxane, the amorphous silica particles, and the particulates described above. The buried conductive backside layer immediately beneath the backside overcoat layer comprises one or more antistatic compounds described above in a mixture of two or more polymers, a "first" polymer that serves to promote adhesion of the buried conductive backside layer to the undercoat layer, and a "second" polymer that serves to promote adhesion of the buried conductive backside layer to the backside overcoat layer.

It is preferred that the film-forming polymer of the backside overcoat layer be of the same class or at least be compatible with the second polymer of the buried conductive backside layer. Preferred film-forming polymers of the backside overcoat layer are polyvinyl acetals such as polyvinyl butyral, or cellulose ester polymers. Cellulose ester polymers such as cellulose acetate butyrate are more preferred. Cellulose acetate butyrate is most preferred. It is also preferred that the polymer of the adhesion promoting, layer and the first polymer of the buried conductive backside layer are the same or different polyester resins.

Representative "first" polymers can be chosen from one or more of the following classes: polyvinyl acetals (such as polyvinyl butyral, polyvinyl acetal, and polyvinyl formal), cellulose ester polymers (such as cellulose acetate, cellulose diacetate, cellulose triacetate, cellulose acetate propionate, hydroxy-methyl cellulose, cellulose nitrate, and cellulose acetate butyrate), polyesters, polycarbonates, epoxies, rosin polymers, polyketone resin, vinyl polymers (such as polyvinyl chloride, polyvinyl acetate, polystyrene, polyacrylonitrile, and butadiene-styrene copolymers), acrylate and methacrylate polymers, and maleic anhydride ester copolymers. The polyvinyl acetals, polyesters, cellulose ester polymers, and vinyl polymers such as polyvinyl acetate and polyvinyl chloride are particularly preferred, and the polyvinyl acetals, polyesters, and cellulose ester polymers are more preferred. Polyester resins are most preferred. Thus, the adhesion-promoting polymers are generally hydrophobic in nature.

Representative "second" polymers include polyvinyl acetals, cellulose ester polymers, vinyl polymers (as defined above for the "first" polymer), acrylate and methacrylate polymers, and maleic anhydride-ester copolymers. The most preferred "second" polymers are polyvinyl acetals and cellulose ester polymers (such as cellulose acetate, cellulose diacetate, cellulose triacetate, cellulose acetate propionate, hydroxymethyl cellulose, cellulose nitrate, and cellulose acetate butyrate). Cellulose acetate butyrate and polyvinyl butyral are particularly preferred second polymers. Of course, mixtures of these second polymers can be used in the buried conductive backside layer. These second polymers are also soluble or dispersible in the organic solvents described above.

It is preferred that the "first" and "second" polymers are compatible with each other or are of the same polymer class. One skilled in the art would readily understand from the teaching herein which polymers are "compatible with" or "of the same class" as those film-forming polymers. For example, it is most preferred to use a single phase mixture of a polyester resin as a "first" polymer and a polyvinyl acetal such as polyvinyl butyral or a cellulose ester polymer such as cellulose acetate butyrate as a "second" polymer". Many of the film-forming polymers useful in the backside overcoat layer are described in other places herein (for example, binders used in imaging layers and or other conventional backside layers).

Organic solvent formulations of the buried conductive backside layer, backside overcoat layer (when present), and outermost backside layer can be simultaneously (wet-on-wet) coated using various coating procedures such as wire wound rod coating, dip coating, air knife coating, curtain coating, slide coating, slot-die coating, or extrusion coating. These procedures are the same as those described above for the thermographic and photothermographic imaging layers.

Imaging/Development

The thermally developable materials can be imaged in any suitable manner consistent with the type of material, using any suitable imaging source to which they are sensitive (typically some type of radiation or electronic signal for photothermographic materials and a source of thermal energy for thermographic materials). In most embodiments, the materials are sensitive to radiation in the range of from about at least 100 nm to about 1400 nm. In some embodiments, they materials are sensitive to radiation in the range of from about 300 nm to about 600 nm, more preferably from about 300 to about 450 nm, even more preferably from a wavelength of from about 360 to 420 nm. In preferred embodiments the materials are sensitized to red or infrared radiation from about 600 to about 1200 nm and more preferably to infrared radiation from about 700 to about 950 nm. If necessary, sensitivity to a particular wavelength can be achieved by using appropriate spectral sensitizing dyes.

Imaging can be carried out by exposing the photothermographic materials to a suitable source of radiation to which they are sensitive, including X-radiation, ultraviolet radiation, visible light, near infrared radiation, and infrared radiation to provide a latent image. Suitable exposure means are well known and include phosphor emitted radiation (particularly X-ray induced phosphor emitted radiation), incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in Research Disclosure, item 38957 (noted above). Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the imagewise exposed photothermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as contacting the material with a heated drum, plates, or rollers, or by providing a heating resistance layer on the rear surface of the material and supplying an electric current to the layer so as to heat the material. A preferred heat development procedure for photothermographic materials includes heating at from 130° C. to about 165° C. for from about 3 to about 25 seconds (and preferably for 20 seconds or less). Line speeds during development of greater than 61 cm/min, such as from 61 to 200 cm/min can be used. Thermal development is carried out with a photothermographic material in a substantially water-free environment and without application of any solvent to the material.

When imaging direct thermographic materials, the image may be "written" simultaneously with development at a suitable temperature using a thermal stylus, a thermal printhead or a laser, or by heating while in contact with a heat-absorbing material. The thermographic materials may include a dye (such as an IR-absorbing dye) to facilitate direct development by exposure to laser radiation.

Thermal development of either thermographic or photothermographic materials is carried out with the material being in a substantially water-free environment and without application of any solvent to the material.

Use as a Photomask

The thermographic and photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed thermographic or photothermographic material provides an image in the imageable material. This method is particularly useful where the imageable medium comprises a printing plate and the photothermographic material serves as an image-setting film.

Thus, in some other embodiments wherein the thermographic or photothermographic material comprises a transparent support, the image-forming method further comprises, after steps (A) and (B) or step (A') noted above:

(C) positioning the imaged, heat-developed photothermographic or thermographic material between a source of imaging radiation and an imageable material that is sensitive to the imaging radiation, and (D) thereafter exposing the imageable material to the imaging radiation through the visible image in the exposed and heat-developed photothermographic material to provide an image in the imageable material.

The following examples are provided to illustrate the practice of the present invention and the invention is not meant to be limited thereby.

Materials and Methods for the Experiments and Examples:

All materials used in the following examples are readily available from standard commercial sources, such as Aldrich Chemical Co. (Milwaukee Wis.) unless otherwise specified. All percentages are by weight unless otherwise indicated. The following additional methods and materials were used.

Many of the chemical components used herein are provided as a solution. The term "active ingredient" means the amount or the percentage of the desired chemical component contained in a sample. All amounts listed herein are the amount of active ingredient added unless otherwise specified.

CAB 381-20 is a cellulose acetate butyrate resin available from Eastman Chemical Co. (Kingsport, Tenn.). It has a butyryl content of about 37%, an acetyl content of about 13.5%, a hydroxyl content of about 1.8%, and a polystyrene equivalent number average molecular weight determined by gel permeation chromatography of about 70,000.

CLOISITE® 20A is a natural montmorillonite that has been modified by reaction with a dimethyl, dihydrogenated-tallow, quaternary ammonium chloride. It is available from Southern Clay Products (Gonzales, Tex.). (http://www.nanoclay.com).

DRYVIEW® Medical Imaging Film is a pbotothermographic film available from Eastman Kodak Health Group (Rochester, N.Y.).

Dow DC510-500cst is a polyphenylmethylsiloxane available from Dow Corning (Midland, Mich.) (http://www.dowcorning.com/).

MEK is methyl ethyl ketone (or 2-butanone).

MeOH is methanol.

SLIP-AYD® SL 1606 is a micronized polyethylene wax. It has an average particle size of 6 μm and a softening range of 135-138° C.

SYLOID® 74×6000 is a synthetic non-spherical amorphous silica that is available from Grace-Davison (Columbia, Md.). It was "classified" prior to use and had a mean particle size of 5.7 μm with a standard deviation of 1.7 μm.

VITEL® PE-2700B LMW is a polyester resin available from Bostik, Inc. (Middleton, Mass.).

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

(BC-1)

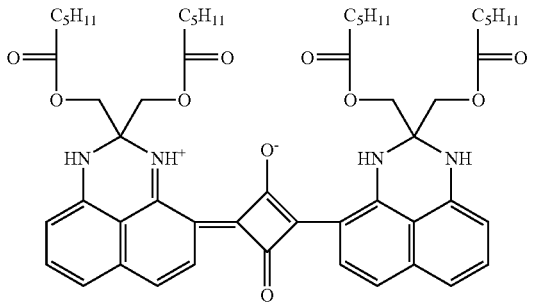

Measurement of Resistivity:

The resistivity of antistatic coatings was measured using two different methods, the "decay time" test and the "Water Electrode Resistivity" (WER) test.

In the "decay time" test, an ETS Model 406D Static Decay Meter (Electro-Tech Systems Inc., Glenside, Pa.) was used to determine the rate of static charge decay on a sample. The sample was subjected to a fixed voltage to induce an electrostatic charge on its surface. The charge was then dissipated (bled off) by providing a path for current flow to ground and the time for the charge to dissipate to certain pre-selected levels (10% in our test) was recorded.

Decay times were measured in a room maintained at 70° F. (21.1° C.)/20% relative humidity (RH) unless otherwise specified. All testing was done in this room after samples had been acclimated for 18 hours. A +5 kV charge was applied and the time to reach 10% of the charge (90% decay) was recorded. Samples that demonstrate poor antistatic properties do not dissipate charge and their decay times are reported as ">100 seconds". In order to function as an antistatic material, a compound should provide a coating having a decay time of 100 seconds or less, preferably 25 seconds or less and more preferably 5 seconds or less at a temperature of 70° F. (21.1° C.) and 20% relative humidity.

In the "water electrode resistivity" (WER) test the internal resistivity of the overcoated buried conductive backside layer is measured using the salt bridge wet electrode resistivity technique described in R. A. Elder *Resistivity Measurements on Buried Conductive Layers*, EOS/ESD Symposium Proceedings, Lake Buena Vista, Fla., 1990, pp. 251-254, and incorporated herein by reference [EOS/ESD stands for Electrical Overstress/Electrostatic Discharge]. A Keithley Electrometer Model 6517A was used. Water electrode resistivity was measured at a potential of 200V. Typically, antistatic layers with log WER values greater than about 12 log ohm/square at 50% relative humidity are considered to be ineffective at providing static protection for photographic imaging elements. Log WER values of 11 log ohm/square or less at 70° F. (21.1° C.) at 50% relative humidity are preferred. We have also found WER measurements to be more predictive of how an antistatic material will perform when used in a commercial product.

Measurement of Haze:

Haze (%) was measured in accord with ASTM D 1003 by conventional means using a Haze-gard Plus Hazemeter that is available from BYK-Gardner (Columbia, Md.). Total haze for thermally developable materials should be as low as possible. It should not be more than 40% and preferably it should not be more than 30%. The haze value of the support is about 2.5±1%. To achieve low total haze, the haze for the backside coatings should also be as low as possible. Preferably the total haze of the support plus the backside layer(s) is 15% or less, preferably 13% or less, and most preferably it is 10% or less. To provide consistent haze measurements, all samples within each Example were coated onto the same lot of support.

Measurement of Adhesion:

Samples were evaluated using a "cross-hatch" adhesion test performed according to ASTM D3359-92A. A coated film was cut with a razor blade in a cross-hatched pattern, a 1 inch (2.54 cm) wide piece of commercially available 3M Type 610 semi-transparent pressure-sensitive tape was placed on the pattern and then quickly lifted off. The amount of coating left on the film is the measure of adhesion. The adhesion test ratings are from 0 to 5 where 0 refers to complete removal of the coating and 5 refers none or very little coating removed. A rating of "3" or greater is considered to be acceptable. 3M Type 610 semi-transparent pressure-sensitive tape was obtained from 3M Company (Maplewood, Minn.).

EXAMPLE 1

Buried Conductive Backside Layer Formulations:

Buried conductive backside layer formulation layer formulations were prepared by mixing the following materials:

| | |
|---|---|
| MEK | 82-96.6 parts |
| MeOH | 0-10 parts |
| Conductive compound | See TABLE I |
| CAB 381-20 | 1.2 parts |
| VITEL ® PE2700 LMW | 0.8 parts |

Most of the compounds were soluble in pure MEK. However, lithium chloride, lithium nitrate, and lithium methacrylate required a 90:10 (wt %) mixture of MEK/MeOH dissolve as all are poorly soluble in MEK.

Outermost Backside Layer Formulation:

An outermost backside layer formulation was prepared by mixing the following materials:

| | |
|---|---|
| MEK | 93.10 parts |
| CAB 381-20 | 6.20 parts |
| SYLOID ® 74X6000 | 0.26 parts |

-continued

| | |
|---|---|
| Backcoat Dye BC-1 | 0.16 parts |
| SLIP-AYD ® SL 1606 | 0.09 parts |
| Dow DC510-500cst | 0.19 parts |

Preparation and Evaluation of Backside Coatings:

The buried conductive backside layer formulation was coated onto a 7 mil (178 μm) blue tinted unprimed poly (ethylene terephthalate) support using an automated knife coater. After drying, the outermost backside layer was coated onto the buried conductive backside layer. Each coating layer was dried for 3 minutes at 93° C. The coating weight of the buried conductive backside layer formulation and the amount of the antistatic compound were adjusted to achieve the coating weights shown in TABLE I. The wet thickness varied between 3 and 21 μm to achieve a dry thickness between 0.2 and 0.9 μm. The outermost backside layer was coated at a wet thickness of 17 μm to give a dry coating weight of 1.0 g/m$^2$.

The solubility of the ionic compounds in the coating formulation was determined. Coated samples were also evaluated for haze, adhesion to the support, coating quality, water electrode resistivity (WER), and static decay time.

Samples were handled with cotton gloves to prevent fingerprints and contamination. Test strips were allowed to acclimate in environmental rooms for 24 hours before measuring WER. Strips were allowed to stabilize for 2 minutes in before measurement.

The data, shown below in TABLES 1, II, and III, provides evidence of the following:

Lithium acetylacetonate, lithium chloride, lithium methacrylate, sodium acetate, sodium fluoride, and potassium acetate were not compatible with the binder and/or solvent system used to prepare the buried conductive backside layer formulation. Lithium chloride also provided coatings with poor adhesion to the support.

Lithium trifluoromethanesulfonimide and lithium nitrate migrated to the surface of the outermost protective layer and produced smearing (a greasy type of substance on surface).

Lithium chloride and lithium methacrylate migrated to the surface of the backside overcoat layer. This resulted in a milky appearing "blushed" coating.

Lithium nonafluorobutanesulfonate and lithium heptadecylfluorooctanesulfonate caused differences in surface tension, which resulted in coating voids. Coating voids can often be overcome by incorporation of a surfactant in the coating solution.

Lithium trifluoroacetate, potassium trifluoroacetate, and sodium trifluoroacetate met all the preferred requirements for use in an organic solvent soluble buried conductive backside layer. They are compatible with the binders and provide clear coatings with low haze. They maintain good adhesion to the support and have rapid static decay times. Of particular importance, their water electrode resistivity appears to be invariant with changes in humidity. The WER measured at 20% and 50% relative humidity differ by less then 0.3 log ohm/sq.

TABLE I

| Conductive Compounds | | | | |
|---|---|---|---|---|
| Sample | Conductive Compound | Ratio of Binder to Conductive Cpd. | Solubility | Coating Weight (g/m$^2$) |
| 1-1-Control | None | N/A | N/A | N/A |
| 1-2-Comparative | Lithium Trifluoromethanesulfonimide | 1:1 | Good | 0.22 |
| 1-3-Comparative | Lithium Trifluoromethanesulfonimide | 1:1 | Good | 0.38 |
| 1-4-Comparative | Lithium Nitrate | 1:0.3 | Good | 0.08 |
| 1-5-Comparative | Lithium Nitrate | 1:1 | Good | 0.10 |
| 1-6-Comparative | Lithium Nitrate | 1:1 | Good | 0.13 |
| 1-7-Inventive | Lithium Nonafluorobutanesulfonate | 1:1 | Good | 0.22 |
| 1-8-Inventive | Lithium Nonafluorobutanesulfonate | 1:1 | Good | 0.70 |
| 1-9-Comparative | Lithium Acetylacetonate | 1:1 | Gelled | |
| 1-10-Comparative | Lithium Chloride | 1:1 | Poor | 0.22 |
| 1-11-Comparative | Lithium Chloride | 1:1 | Poor | 0.38 |
| 1-12-Comparative | Potassium Acetate | 1:1 | Insoluble | |
| 1-13-Comparative | Sodium Acetate | 1:1 | Insoluble | |
| 1-14-Comparative | Lithium Methacrylate | 1:1 | Poor | 0.22 |
| 1-15-Comparative | Lithium Methacrylate | 1:1 | Poor | 0.34 |
| 1-16-Comparative | N-Ethylsulfonic acid-2-bromoacetamide, Lithium salt | 1:1 | Good | 0.22 |
| 1-17-Comparative | N-Ethylsulfonic acid-2-bromoacetamide, Lithium salt | 1:1 | Good | 0.34 |
| 1-18-Comparative | Sodium Fluoride | 1:1 | Turbid | 0.22 |
| 1-19-Comparative | Sodium Fluoride | 1:1 | Turbid | 0.68 |
| 1-20-Inventive | Lithium Trifluoroacetate | 1:1 | Good | 0.14 |
| 1-21-Inventive | Lithium Trifluoroacetate | 1:1 | Good | 0.22 |
| 1-22-Inventive | Lithium Trifluoroacetate | 1:2 | Good | 0.38 |
| 1-23-Inventive | Lithium Trifluoroacetate | 1:2 | Good | 0.84 |
| 1-24-Inventive | Lithium Trifluoroacetate | 1:2 | Good | 1.12 |
| 1-25-Inventive | Potassium Trifluoroacetate | 1:1 | Good | 0.15 |
| 1-26-Inventive | Potassium Trifluoroacetate | 1:1 | Good | 0.22 |
| 1-27-Inventive | Potassium Trifluoroacetate | 1:1 | Good | 0.45 |
| 1-28-Inventive | Potassium Trifluoroacetate | 1:1 | Good | 0.67 |
| 1-29-Inventive | Sodium Trifluoroacetate | 1:1 | Good | 0.22 |
| 1-30-Inventive | Sodium Trifluoroacetate | 1:1 | Good | 0.45 |
| 1-31-Inventive | Sodium Trifluoroacetate | 1:1 | Good | 0.67 |
| 1-32-Inventive | Lithium Heptadecylfluorooctanesulfonate | 1:1 | Turbid | 0.22 |
| 1-33-Inventive | Lithium Tetrafluoroborate | 1:0.75 | Good | 0.19 |
| 1-34-Inventive | Lithium Tetrafluoroborate | 1:0.75 | Good | 0.28 |

TABLE II

| Sample | Conductive Compound | Physical Properties: WER @ 20% RH (log ohm/sq) | WER @ 50% RH (log ohm/sq) | Static Decay Time @ 20% RH (seconds) |
|---|---|---|---|---|
| 1-1-Control | None | 12.06 | 12.33 | >100 |
| 1-2-Comparative | Lithium Trifluoromethanesulfonimide | 10.85 | 10.94 | — |
| 1-3-Comparative | Lithium Trifluoromethanesulfonimide | 10.80 | 10.87 | — |
| 1-4-Comparative | Lithium Nitrate | 11.95 | 10.93 | — |
| 1-5-Comparative | Lithium Nitrate | 10.97 | 10.91 | — |
| 1-6-Comparative | Lithium Nitrate | 10.97 | 10.90 | 0.01 |
| 1-7-Inventive | Lithium Nonafluorobutanesulfonate | 10.99 | 10.79 | — |
| 1-8-Inventive | Lithium Nonafluorobutanesulfonate | 10.94 | 10.75 | — |
| 1-9-Comparative | Lithium Acetylacetonate | — | — | — |
| 1-10-Comparative | Lithium Chloride | 10.91 | 10.78 | — |
| 1-11-Comparative | Lithium Chloride | 10.81 | 10.81 | — |
| 1-12-Comparative | Potassium Acetate | — | — | — |
| 1-13-Comparative | Sodium Acetate | — | — | — |
| 1-14-Comparative | Lithium Methacrylate | 10.94 | 11.0 | — |
| 1-15-Comparative | Lithium Methacrylate | 10.91 | 10.94 | — |
| 1-16-Comparative | N-Ethylsulfonic acid-2-bromoacetamide, Lithium salt | 10.90 | 10.83 | — |
| 1-17-Comparative | N-Ethylsulfonic acid-2-bromoacetamide, Lithium salt | 10.80 | 10.71 | >100 |
| 1-18-Comparative | Sodium Fluoride | 9.84 | 9.91 | — |
| 1-19-Comparative | Sodium Fluoride | 9.80 | 9.38 | — |
| 1-20-Inventive | Lithium Trifluoroacetate | 11.20 | 11.17 | — |
| 1-21-Inventive | Lithium Trifluoroacetate | 10.68 | 10.68 | — |
| 1-22-Inventive | Lithium Trifluoroacetate | 9.21 | 8.99 | — |
| 1-23-Inventive | Lithium Trifluoroacetate | 7.96 | 8.00 | — |
| 1-24-Inventive | Lithium Trifluoroacetate | 8.99 | 8.01 | 0.01 |
| 1-25-Inventive | Potassium Trifluoroacetate | 11.51 | 11.46 | — |
| 1-26-Inventive | Potassium Trifluoroacetate | 10.40 | 10.56 | — |
| 1-27-Inventive | Potassium Trifluoroacetate | 11.05 | 10.88 | — |
| 1-28-Inventive | Potassium Trifluoroacetate | 10.93 | 10.87 | 15.05 |
| 1-29-Inventive | Sodium Trifluoroacetate | 10.51 | 10.21 | — |
| 1-30-Inventive | Sodium Trifluoroacetate | 9.48 | 9.26 | 20.08 |
| 1-31-Inventive | Sodium Trifluoroacetate | 9.28 | 9.14 | 23.71 |
| 1-32-Inventive | Lithium Heptadecylfluorooctanesulfonate | 11.33 | 10.9 | 0.01 |

TABLE II-continued

| Sample | Conductive Compound | Physical Properties: WER @ 20% RH (log ohm/sq) | WER @ 50% RH (log ohm/sq) | Static Decay Time @ 20% RH (seconds) |
|---|---|---|---|---|
| 1-33-Inventive | Lithium Tetrafluoroborate | 10.75 | 10.72 | 22.01 |
| 1-34-Inventive | Lithium Tetrafluoroborate | 10.83 | 10.96 | 2.3 |

TABLE III

| Sample | Conductive Compound | Physical Properties: Haze | Adhesion | Coating Quality |
|---|---|---|---|---|
| 1-1-Control | None | 8.5 | 5 | Good |
| 1-2-Comparative | Lithium Trifluoromethanesulfonimide | 10.9 | 4 | Smeared |
| 1-3-Comparative | Lithium Trifluoromethanesulfonimide | 11.1 | 2 | Smeared |
| 1-4-Comparative | Lithium Nitrate | 9.5 | 5 | Smeared |
| 1-5-Comparative | Lithium Nitrate | 9.3 | 5 | Smeared |
| 1-6-Comparative | Lithium Nitrate | 10.0 | 5 | Smeared |
| 1-7-Inventive | Lithium Nonafluorobutanesulfonate | 10.1 | 5 | Coating Voids |
| 1-8-Inventive | Lithium Nonafluorobutanesulfonate | 10.4 | 5 | Coating Voids |
| 1-9-Comparative | Lithium Acetylacetonate | — | — | — |
| 1-10-Comparative | Lithium Chloride | 22 | 0 | Blush |
| 1-11-Comparative | Lithium Chloride | 54 | 0 | Blush |
| 1-12-Comparative | Potassium Acetate | — | — | — |
| 1-13-Comparative | Sodium Acetate | — | — | — |
| 1-14-Comparative | Lithium Methacrylate | 9.2 | 5 | Slight Blush |
| 1-15-Comparative | Lithium Methacrylate | 9.9 | 4 | Slight Blush |
| 1-16-Comparative | N-Ethylsulfonic acid-2-bromoacetamide, Lithium salt | 10.1 | 5 | Good |
| 1-17-Comparative | N-Ethylsulfonic acid-2-bromoacetamide, Lithium salt | 11.4 | 5 | Good |
| 1-18-Comparative | Sodium Fluoride | 9.9 | 5 | Good |
| 1-19-Comparative | Sodium Fluoride | 10.0 | 5 | Good |
| 1-20-Inventive | Lithium Trifluoroacetate | 9.3 | 5 | Good |
| 1-21-Inventive | Lithium Trifluoroacetate | 9.2 | 5 | Good |
| 1-22-Inventive | Lithium Trifluoroacetate | 10 | 5 | Good |
| 1-23-Inventive | Lithium Trifluoroacetate | 9.8 | 4 | Good |
| 1-24-Inventive | Lithium Trifluoroacetate | 10 | 4 | Good |
| 1-25-Inventive | Potassium Trifluoroacetate | 9.8 | 5 | Good |
| 1-26-Inventive | Potassium Trifluoroacetate | 9.9 | 5 | Good |
| 1-27-Inventive | Potassium Trifluoroacetate | 10.8 | 5 | Good |
| 1-28-Inventive | Potassium Trifluoroacetate | 11.6 | 5 | Good |
| 1-29-Inventive | Sodium Trifluoroacetate | 9.9 | 5 | Good |
| 1-30-Inventive | Sodium Trifluoroacetate | 9.9 | 5 | Good |

TABLE III-continued

| Sample | Conductive Compound | Physical Properties: Haze | Adhesion | Coating Quality |
|---|---|---|---|---|
| 1-31-Inventive | Sodium Trifluoroacetate | 10 | 5 | Good |
| 1-32-Inventive | Lithium Heptadecyl-fluorooctane-sulfonate | 10.4 | 5 | Coating Voids |
| 1-33-Inventive | Lithium Tetrafluoroborate | 10.6 | 3 | Good |
| 1-34-Inventive | Lithium Tetrafluoroborate | 13.4 | 1 | Good |

EXAMPLE 2

Buried Conductive Backside Layer Formulation:

A buried conductive backside layer formulation layer formulation was prepared by mixing the following materials:

| | |
|---|---|
| MEK | 95.1 parts |
| Sodium Trifluoroacetate | 2.9 parts |
| CAB 381-20 | 1.2 parts |
| VITEL ® PE2700 LMW | 0.8 parts |

Outermost Backside Layer Formulation:

An outermost backside layer formulation was prepared by mixing the following materials:

| | |
|---|---|
| MEK | 93.72 parts |
| CAB 381-20 | 5.64 parts |
| "Classified" SYLOID ® 74X6000 | 0.24 parts |
| Backcoat Dye BC-1 | 0.15 parts |
| SLIP-AYD ® SL 1606 | 0.08 parts |
| Dow DC510-500cst | 0.17 parts |

Preparation and Evaluation of Backside Coatings:

The buried conductive backside layer formulation and outermost backside layer formulations were simultaneously coated onto the backside of a strip of DRYVIEW® Medical Imaging Film. The support was 7 mil (178 μm), blue tinted, unprimed poly(ethylene terephthalate). The backside surface of this film was unprimed. The buried conductive backside layer served as a carrier layer for the outermost backside layer. A precision automated multilayer knife coater equipped with an in-line dryer was used. The dry coating weight of the buried conductive backside layer formulation was approximately 0.6 g/m$^2$ to achieve a dry thickness of 0.7 μm. The outermost backside layer was coated at to achieve a dry coating weight of 1.0 g/m$^2$ and a dry thickness of 1.2 μm. Samples were dried for 3 minutes at 93° C.

Samples containing the buried conductive backside coatings were evaluated for haze, adhesion to the support, coating quality (such as smearing, blushing, and coating voids), water electrode resistivity (WER), and static decay time as described in Example 1. The data, shown below in TABLES IV and V, provides evidence that buried conductive backside layers containing sodium trifluoroacetate have low haze, good conductivity, rapid charge decay, excellent adhesion to the substrate, and good coating quality, and can be used to prepare buried conductive backside layers in thermally developable materials.

TABLE IV

| Sample | Conductive Compound: Conductive Compound | Ratio of Binder to Conductive Cpd. | Solubility | Coating Weight (g/m$^2$) |
|---|---|---|---|---|
| 2-1-Inventive | Sodium Trifluoroacetate | 1:1 | Good | 0.3 |

TABLE V

| Sample | Physical Properties: WER @ 50% RH (log ohm/sq) | Static Decay Time @ 20% RH (sec.) | Haze | Adhesion | Coating Quality |
|---|---|---|---|---|---|
| 2-1-Inventive | 8.5 | 8.1 | 5.4 | 5 | Excellent |

EXAMPLE 3

Outermost layer coating formulations and buried conductive backside layer coating formulations incorporating various compounds were prepared, coated, dried, and tested as described in Example 1. All compounds were soluble in MEK and no methanol was added. Sample formulations and data, shown below in TABLES VI, VII, and VIII provides evidence of the following:

Buried backside layers containing sodium heptafluorobutyrate, a perflouroalkyl carboxylic acid having 4 carbon atoms provide constructions having acceptable water electrode resistivity and unacceptable static decay times. Samples containing higher levels of this material also exhibited coating voids.

Buried backside layers containing sodium pentafluoropropionate, a perflouroalkyl carboxylic acid having 3 carbon atoms provide constructions that have acceptable water electrode resistivity and acceptable static decay times.

Buried backside layers containing zinc trifluoroacetate hydrate a perfluoroalkyl carboxylic acid not having a alkali metal cation, provide constructions having acceptable water electrode resistivity and unacceptable static decay times.

TABLE VI

| Sample | Conductive Compound | Ratio of Binder to Conductive Cpd | Solubility | Coating Weight (g/m$^2$) |
|---|---|---|---|---|
| 3-1-Comparative | Sodium Heptafluorobutyrate | 1:1 | Good | 0.34 |
| 3-2-Comparative | Sodium Heptafluorobutyrate | 1:2 | Good | 0.22 |
| 3-3-Comparative | Sodium Heptafluorobutyrate | 1:2 | Good | 0.67 |
| 3-4-Inventive | Sodium Pentafluoropropionate | 1:1 | Good | 0.22 |
| 3-5-Inventive | Sodium Pentafluoropropionate | 1:1 | Good | 0.67 |
| 3-6-Comparative | Zinc Trifluoroacetate hydrate | 1:1 | Good | 0.22 |
| 3-7-Comparative | Zinc Trifluoroacetate hydrate | 1:1 | Good | 0.67 |

TABLE VII

| Sample | Conductive Compound | Physical Properties: Haze | Adhesion | Coating Quality |
|---|---|---|---|---|
| 3-1-Comparative | Sodium Hepta-fluorobutyrate | 9.7 | 5 | Good |
| 3-2-Comparative | Sodium Hepta-fluorobutyrate | 8.6 | 5 | Coating Voids |
| 3-3-Comparative | Sodium Hepta-fluorobutyrate | 9.5 | 5 | Coating Voids |
| 3-4-Inventive | Sodium Penta-fluoropropionate | 9.6 | 5 | Good |
| 3-5-Inventive | Sodium Penta-fluoropropionate | 11.1 | 5 | Good |
| 3-6-Comparative | Zinc Trifluoro-acetate hydrate | 9.9 | 5 | Good |
| 3-7-Comparative | Zinc Trifluoro-acetate hydrate | 11.2 | 5 | Good |

TABLE VIII

| Sample | Conductive Compound | Physical Properties: WER @ 20% RH (log ohm/sq) | WER @ 50% RH (log ohm/sq) | Static Decay Time @ 20% RH (seconds) |
|---|---|---|---|---|
| 3-1-Comparative | Sodium Hepta-fluorobutyrate | 11.1 | 11.0 | — |
| 3-2-Comparative | Sodium Hepta-fluorobutyrate | 11.2 | 11.1 | — |
| 3-3-Comparative | Sodium Hepta-fluorobutyrate | 10.7 | 10.7 | >100 |
| 3-4-Inventive | Sodium Penta-fluoropropionate | 11.6 | 11.4 | 60 |
| 3-5-Inventive | Sodium Penta-fluoropropionate | 10.9 | 10.9 | 60 |
| 3-6-Comparative | Zinc Trifluoro-acetate hydrate | 11.4 | 11.4 | — |
| 3-7-Comparative | Zinc Trifluoro-acetate hydrate | 11.3 | 11.3 | >100 |

The invention has been described in detail with particular reference to certain preferred embodiments thereof, but it will be understood that variations and modifications can be effected within the spirit and scope of the invention.

The invention claimed is:

1. A thermally developable material that comprises a support having on one side thereof, one or more thermally developable imaging layers comprising a binder and in reactive association, a non-photosensitive source of reducible silver ions, and a reducing agent composition for said non-photosensitive source reducible silver ions, and having disposed on the backside of said support:

a buried conductive backside layer comprising one or more organic solvent soluble hydrophobic binder polymers, and an antistatic compound that is an organic solvent soluble alkali metal salt of a perfluorinated aliphatic carboxylic acid having 2 or 3 carbon atoms, a perfluorinated aliphatic sulfonate, or tetrafluoroborate, that is present in an amount sufficient to provide a water electrode resistivity of $1\times10^{12}$ ohm/sq or less at 21.1° C. and 50% relative humidity, and a static decay time of less than 100 seconds at 21.1° C. and 20% relative humidity, and an outermost backside layer.

2. The thermally developable material of claim 1 wherein said antistatic compound has a molecular weight of from about 120 to about 202.

3. The thermally developable material of claim 1 wherein said antistatic compound is present in an amount of from about 0.02 to about 2 g/m$^2$.

4. The thermally developable material of claim 1 wherein the one or more thermally developable imaging layers is a photothermographic emulsion layer that further comprises a photosensitive silver halide.

5. The thermally developable material of claim 1 wherein said antistatic compound is one or more trifluoroacetate salts of lithium, sodium, or potassium, lithium nonafluorobutanesulfonate, lithium heptadecylfluorooctanesulfonate, or lithium tetrafluoroborate.

6. The thermally developable material of claim 1 wherein said outermost backside layer further comprises a polysiloxane.

7. The thermally developable material of claim 6 wherein said polysiloxane is present in an amount of from about 1.5 to about 6 weight % based on the dry weight of said binder polymer in said outermost backside layer.

8. The thermally developable material of claim 1 wherein said outermost backside layer further comprises amorphous silica particles.

9. The thermally developable material of claim 1 wherein said outermost backside layer further comprises one or more of a smectite clay that has been modified with a quaternary ammonium compound, or wax or polytetrafluoroethylene particulates.

10. The thermally developable material of claim 1 wherein said antistatic compound is present in said buried conductive backside layer in an amount sufficient to provide a water electrode resistivity of $1\times10^{11}$ ohm/sq or less at 21.1° C. and 50% relative humidity and a static decay time of 25 seconds or less at 21.1° C. and 20% relative humidity.

11. The thermally developable material of claim 1 wherein said buried conductive backside layer and said outermost backside layer are the only layers on the backside of said support.

12. The thermally developable material of claim 1 wherein the total haze of said support plus all backside layers is 15% or less.

13. The thermally developable material of claim 1 wherein the ratio of dry thickness of said buried conductive backside layer to the dry thickness of said outermost backside layer is from about 0.01:1 to about 1:1.

14. The thermally developable material of claim 1 that is a photothermographic material comprising a photosensitive silver bromide or silver iodobromide, said thermally developable imaging layer(s) binder is a hydrophobic binder, said non-photosensitive source of reducible silver ions is a silver salt of an organic carboxylic acid, and said reducing agent composition comprises a hindered phenol, a hindered bisphenol, or a combination thereof.

15. The thermally developable material of claim 1 wherein the silver coating weight is less than 2.3 g/m$^2$.

16. A method of forming a visible image comprising:

A) imagewise exposing the thermally developable material of claim 1 that is a photothermographic material to electromagnetic radiation to form a latent image, and B) simultaneously or sequentially, heating said exposed photothermographic material to develop said latent image into a visible image.

17. The method of claim 16 wherein said development is carried out for 15 seconds or less.

18. The method of claim 16 wherein said imagewise exposing is carried out using laser imaging at from about 700 to about 950 nm.

19. The method of claim 16 wherein said imagewise exposing and development is carried out while said photothermographic material is moved at a line speed of at least 61 cm/min.

20. A black-and-white, organic solvent-based photothermographic material comprising a support and A) having on an imaging side of said support, one or more photothermographic emulsion layers, and a protective layer disposed over said photothermographic emulsion layers, and in reactive association:

photosensitive grains of silver bromide or iodobromide that are sensitized to an exposure wavelength of at least 600 nm, one or more silver salts of aliphatic fatty acids including silver behenate, a reducing agent composition comprising a hindered phenol, a hindered bisphenol, or a combination thereof, and a hydrophobic, organic solvent-soluble binder, B) having on the backside of said support, a buried conductive backside layer comprising one or more first organic solvent soluble hydrophobic binder polymers in which is dissolved one or more alkali metal salts of a perfluorinated aliphatic carboxylic acid having 2 or 3 carbon atoms in an amount of from about 0.02 to about 2 $g/m^2$ to provide a water electrode resistivity of $1\times10^{11}$ ohm/sq or less at 21.1° C. and 50% relative humidity, and disposed directly on said buried conductive backside layer, an outermost backside layer comprising one or more second hydrophobic binder polymers at least one of which differs from said first hydrophobic binder polymers, and one or more of a polysiloxane, amorphous silica particles, a smectite clay that has been modified with a quaternary ammonium compound, a wax, or polytetrafluoroethylene particulates, wherein:

C) the silver coating weight of said photothermographic material is from about 1 to about 2 $g/m^2$, the absorbance on said imaging side at an exposure wavelength is at least 0.6, and the absorbance on said backside at an exposure wavelength is at least 0.2, said buried conductive backside layer and said outermost backside layer exhibit a haze of 13% or less, and a static decay time of 25 seconds or less.

21. The photothermographic material of claim 20 wherein said antistatic agent is one or more of a lithium, sodium, or potassium trifluoroacetate.

22. A method of preparing a thermally developable material that comprises a support having on one side thereof, one or more thermally developable imaging layers comprising a binder and in reactive association, a non-photosensitive source of reducible silver ions, and a reducing agent composition for said non-photosensitive source reducible silver ions, and having disposed on the backside of said support, a buried conductive backside layer comprising one or more organic solvent soluble hydrophobic binder polymers, and an antistatic compound that is an organic solvent soluble alkali metal salt of a perfluorinated aliphatic carboxylic acid having 2 or 3 carbon atoms, a perfluorinated aliphatic sulfonate, or tetrafluoroborate, that is present in an amount sufficient to provide a water electrode resistivity of $1\times10^{12}$ ohm/sq or less at 21.1° C. and 50% relative humidity, and a static decay time of less than 100 seconds at 21.1° C. and 20% relative humidity, and an outermost backside layer, said method comprising applying buried conductive backside layer and outermost backside layer formulations in the same or different organic solvents that exclude methanol or include methanol in an amount of 10% or less, based on total organic solvent volume.

23. The method of claim 22 wherein said buried conductive backside layer and outermost backside layer formulations are simultaneously applied out of 2-butanone, toluene, ethyl acetate, methyl isobutyl ketone, tetrahydrofuran, or mixtures thereof.

* * * * *